US006502435B2

(12) United States Patent
Watts et al.

(10) Patent No.: US 6,502,435 B2
(45) Date of Patent: Jan. 7, 2003

(54) LOCKS

(75) Inventors: John Russell Watts, South Melbourne (AU); Dion Geoffrey Bright, South Melbourne (AU)

(73) Assignee: Yarra Ridge Pty LTD, South Melbourne (AU)

( * ) Notice: Subject to any disclaimer, the term of this patent is extended or adjusted under 35 U.S.C. 154(b) by 0 days.

(21) Appl. No.: 09/880,520

(22) Filed: Jun. 13, 2001

(65) Prior Publication Data

US 2002/0017120 A1 Feb. 14, 2002

(30) Foreign Application Priority Data

| | | |
|---|---|---|
| Jun. 13, 2000 | (AU) | PQ8120 |
| Jun. 15, 2000 | (AU) | PQ8160 |
| Jun. 15, 2000 | (AU) | PQ8167 |
| Jul. 5, 2000 | (AU) | PQ8563 |
| Jul. 26, 2000 | (AU) | PQ8981 |
| Aug. 21, 2000 | (AU) | PQ9512 |
| Nov. 13, 2000 | (AU) | PR1436 |
| Nov. 27, 2000 | (AU) | PR1706 |
| Feb. 8, 2001 | (AU) | PR2991 |

(51) Int. Cl.[7] ..... E05B 65/08

(52) U.S. Cl. ..... 70/95; 70/90; 70/91; 70/100; 70/224; 403/122; 292/336.3; 292/DIG. 46

(58) Field of Search ..... 70/90, 91, 95, 70/100, 224; 403/122; 292/336.3, DIG. 46

(56) References Cited

U.S. PATENT DOCUMENTS

| | | | | | |
|---|---|---|---|---|---|
| 479,104 | A | * | 7/1892 | Fleischel et al. | 70/99 |
| 1,667,600 | A | | 3/1927 | Martinek | |
| 2,224,671 | A | | 6/1939 | Crooks | 70/151 |
| 2,253,495 | A | | 3/1940 | Cordrey | 70/447 |
| 2,701,157 | A | * | 2/1955 | Le Bon, III | 292/113 |
| 3,025,693 | A | * | 3/1962 | Braginetz | 70/100 |
| 3,046,776 | A | * | 7/1962 | Marotto et al. | 70/97 |
| 3,175,376 | A | * | 3/1965 | Cantwell | 70/131 |
| 3,695,068 | A | * | 10/1972 | Eads et al. | 70/107 |
| 3,899,201 | A | | 8/1975 | Paioletti | 292/25 |
| 4,434,635 | A | * | 3/1984 | Borgato | 70/279 |
| 4,534,191 | A | | 8/1985 | Rogers | 70/116 |
| 4,691,543 | A | * | 9/1987 | Watts | 70/143 |
| 4,973,091 | A | | 11/1990 | Paulson | 292/51 |
| 5,009,089 | A | | 4/1991 | Lin | 70/114 |
| 5,092,144 | A | * | 3/1992 | Fleming et al. | 70/95 |
| 5,373,716 | A | * | 12/1994 | MacNeil et al. | 70/109 |

(List continued on next page.)

FOREIGN PATENT DOCUMENTS

| | | |
|---|---|---|
| AU | 633318 | 11/1990 |
| AU | 659035 | 4/1994 |
| AU | 694581 | 4/1996 |
| AU | 701788 | 9/1996 |
| AU | 199914699 | 2/1999 |
| AU | 200015295 | 2/2000 |
| AU | 200053558 | 8/2000 |
| DE | 3307618 | 11/1983 |
| GB | 536578 | 5/1941 |
| GB | 2239892 | 7/1997 |

*Primary Examiner*—Robert J. Sandy
*Assistant Examiner*—Carlos Lugo
(74) *Attorney, Agent, or Firm*—Sughrue Mion, PLLC

(57) ABSTRACT

A manual lock for a moveable wing comprising a hollow frame supporting an in-fill portion and defined by an interior and an opposed exterior side, the manual lock including an engageable member, a casing, engaging member including at least one engaging member supported by the casing and displaceable to a latched configuration to be engaged with the engageable member, to restrain the wing from displacing in an opening direction, and operating member to cause each engaging member to displace to and from the latched configuration including a hand operable interior-operating member operably connected by a rocker to each engaging member by a slide member including a rectilinearly displaceable slide.

10 Claims, 18 Drawing Sheets

U.S. PATENT DOCUMENTS 5,516,161 A * 5/1996 Mader et al. ..... 292/34
5,540,066 A * 7/1996 Takimoto ..... 70/99
5,582,442 A * 12/1996 Nolte ..... 292/101
5,722,704 A * 3/1998 Chaput et al. ..... 292/26
5,820,170 A * 10/1998 Clancy ..... 292/26
5,951,068 A * 9/1999 Strong et al. ..... 292/39
6,270,129 B1 * 8/2001 Prevot et al. ..... 292/162
6,327,879 B1 * 12/2001 Malsom ..... 70/97

* cited by examiner

LOCKS

BACKGROUND

This invention relates to locks for moveable wings such as windows and doors and in particular it relates to locks for doors comprised of a narrow frame with an infill material such as glass or mesh to which a lock cannot be attached. The door construction necessitates attaching the lock to the frame which unfortunately often causes an exterior cylinder to be located close to the opening frame surrounding the door providing poor accessibility to the cylinder and making operation of the key difficult.

Another difficulty often encountered relates to locking the door after departing. Most commonly available self-latching locks provide for locking from the exterior, but when locked the lock must be unlocked either from the interior or exterior by key. It is thought an advantage to be able to lock a lock from the exterior while enabling it to be unlocked from the interior by a hand operable operating member and without the need to employ a key—it is thought to be particularly advantageous in panic situations. Many commonly available manual locks provide for simultaneous latching and locking from the exterior, but when locked the lock must be unlocked either from the interior or exterior by key. It is thought an advantage to be able to latch a lock from the exterior while enabling it to be unlatched from the interior by operating member and without the need to employ a key—is thought to be particularly advantageous in panic situations.

SUMMARY OF THE INVENTION

An object of the present invention is to provide a manual lock for a moveable wing comprising a hollow frame supporting an in-fill portion and defined by an interior and an opposed exterior side, the manual lock including an engageable means, a casing, engaging means including at least one engaging member supported by the casing and displaceable to a latched configuration to be engaged with the engageable member, to restrain the wing from displacing in an opening direction operating means to cause each engaging member to displace to and from the latched configuration including a hand operable interior-operating member operably connected by a rocker to each engaging member by slide means including a rectilinearly displaceable slide, the operating means further including a cylinder having a key operable barrel operably coupled to a first pinion, the first pinion and slide being operably connected by a drive recess of the slide disposed towards the first pinion and defined by a first drive shoulder and the second drive shoulder and a protruding third drive shoulder of the first pinion radially disposed from the axis of rotation of the first pinion and which locates between the first and second drive shoulders to couple the slide and first pinion whereby displacement of one causes displacement of the other, the slide being displaceable to and from a latching position corresponding to each engaging member being latched by operation of the interior-operating member to cause the rocker to displace to cause the slide to displace and by operation of the cylinder to cause the first pinion to displace to cause the slide to displace, the manual lock being displaceable to a first locked configuration characterized by the slide being in the latching position, each engaging member being latched and the first pinion being in a further displaced position wherein the third drive shoulder has left the drive recess to abut the surface of the exit shoulder which is then defined by a normal vector which passes through the axis of rotation of the first pinion, the slide thereby being unable to exert a moment on the first pinion to cause the first pinion to rotate to thereby be restrained from displacing by the first pinion.

An object of the present invention is to provide a self-latching lock for a moveable wing comprising a hollow frame supporting an in-fill portion and defined by an interior and an exterior side, the self-latching lock including an engageable means, a casing, engaging means including at least one engaging member supported by the casing and displaceable to a latched configuration corresponding to a latched lock to be engaged with the engageable means, to restrain the wing from displacing in an opening direction, operating means to cause each engaging member to displace from the latched configuration including a hand operable interior-operating member and a hand operable exterior-operating member each operably connected by a rocker to each engaging member by slide means including a rectilinearly displaceable slide, locking means including a deadlocking slide comprising a support slide, a cylinder having a key operable barrel operably coupled to a first pinion and an interior-snibbing member operably coupled to the deadlocking slide by a locking-cam having an arm with an end shoulder, the first pinion and deadlocking slide being operably connected by a drive recess of the deadlocking slide disposed towards the first pinion and defined by a first drive shoulder and a second drive shoulder and a protruding third drive shoulder radially disposed from the axis of rotation of the first pinion and which locates between the first and second drive shoulders to couple the deadlocking slide and first pinion whereby displacement of one causes displacement of the other, the deadlocking slide being displaceable to and from a locking configuration corresponding to a latched lock by operation of the interior-snibbing member to cause the cam to rotate to cause the deadlocking slide to displace and by operation of the cylinder to cause the first pinion to displace to cause the deadlocking slide to displace, the lock being so lockable to a second locked configuration characterized by the third drive shoulder being within the drive recess and the arm end shoulder being adjacent to a portion of the slide defined by a normal vector which passes through the axis of rotation of the locking-cam, the slide thereby being unable to exert a moment on the locking-cam to cause the locking-cam to rotate, the slide thereby being restrained from displacing from the locking configuration, the lock being lockable to a first locked configuration from which it can only be unlocked by the cylinder, the first locked configuration being characterized by the first pinion being further displaced to have caused the third drive shoulder to leave the drive recess and to abut the surface of the exit shoulder which is then defined by a normal vector which passes through the axis of rotation of the first pinion, the deadlocking slide thereby being unable to exert a moment on the first pinion to cause the first pinion to rotate to thereby be restrained from displacing

DESCRIPTION OF THE PREFERRED EMBODIMENTS

The invention provides multiple improved locks and improvements in locks that are transportable into other locks and locking devices without being limited to the applications described herein.

The improved lock range references two types of locks; a manual lock where the engaging members are moved between an extended, latching position and a retracted, disengaged, position by manipulation of a key or hand operable operating member; and a self latching lock in which the engaging members are moved to the extended position by biasing means and moveable to the retracted position by manipulation of an operating member. Many of the components employed in the manual lock are also employ ed in the self-latching lock.

The manual lock is described in detail first and the self-latching lock is then described relative to this manual lock. Within this invention the words meshes with means, in the direction of engagement, engaging with but without free movement. For example, meshing between an angularly displaceable shaft and a recess in an angularly displaceable pinion ensures that they both angularly displace the same, though the shaft is permitted to displace longitudinally in relation to the pinion.

In preferred embodiments of the manual and self-latching lock s there is a lock body mountable to a displaceable wing suspended adjacent to an opening and an engageable means associated with an element defining part of the wing opening such that when the lock body and engageable means are engaged with each other, the wing is restrained from being moved in an opening direction; the wing comprising a substantially hollow frame supporting an in-fill material such as glass or expanded mesh.

Figure 1:
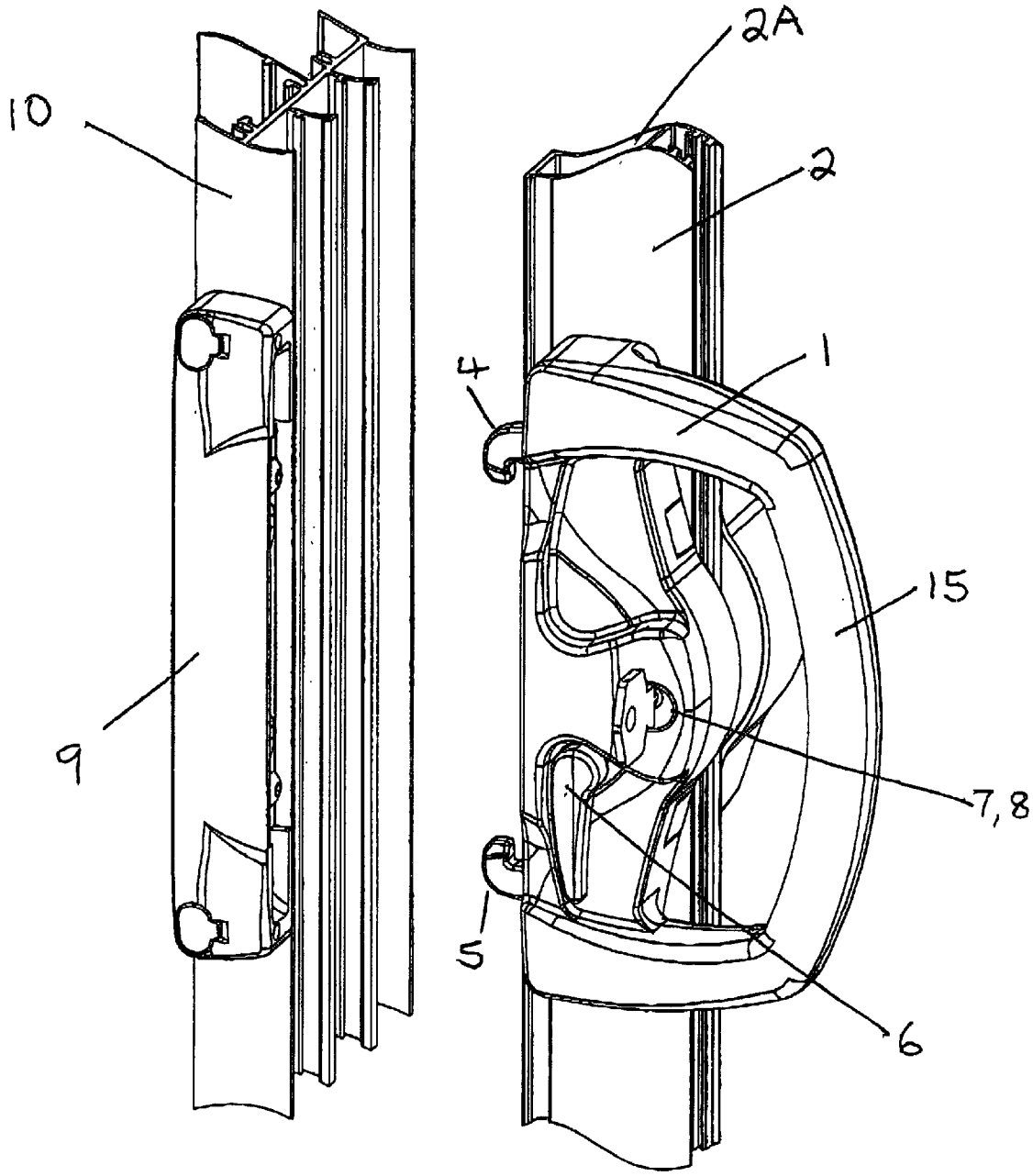
FIG. 1 is a perspective view of the lock and wing when viewed from the interior of the wing.
Figure 2:
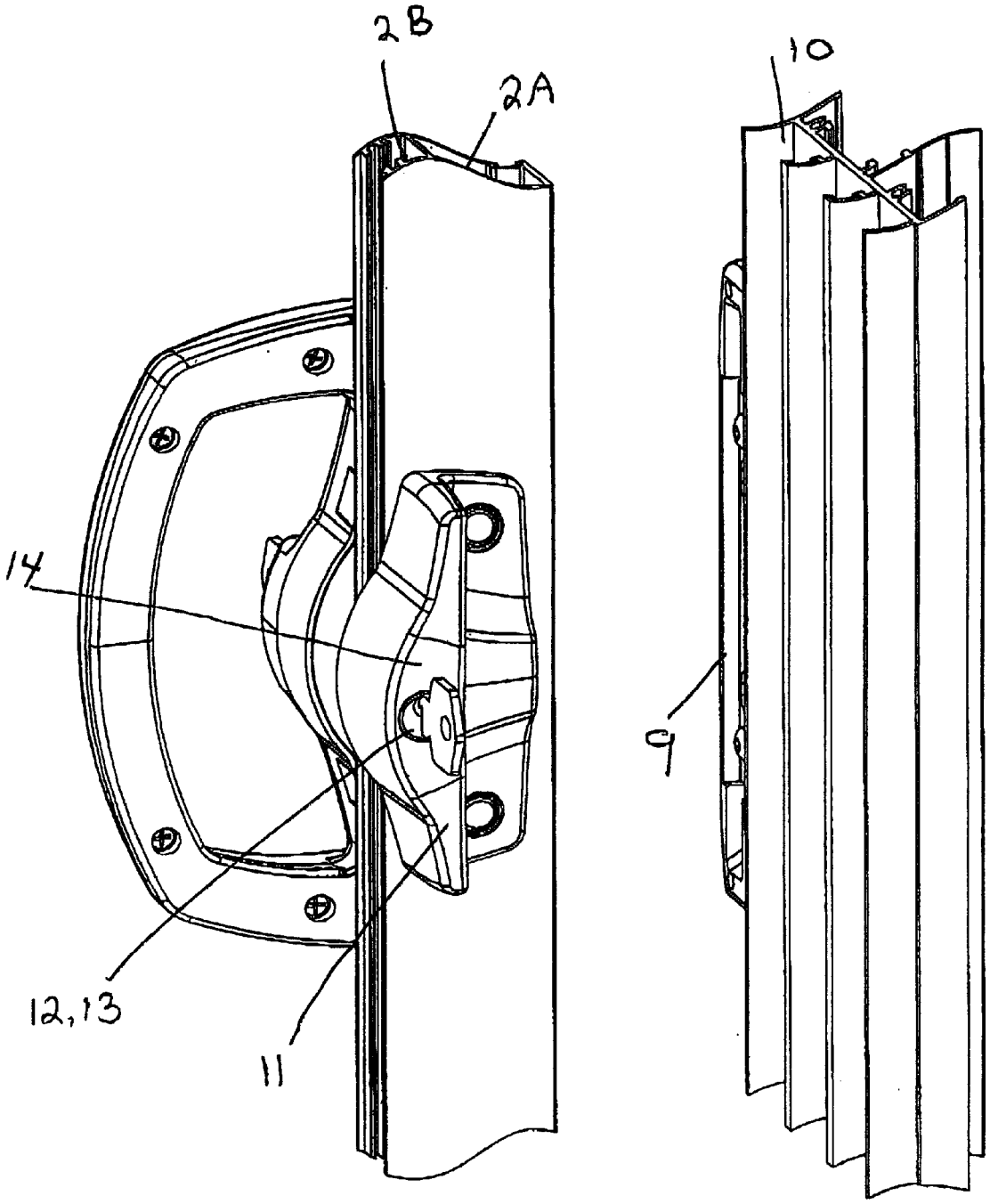
FIG. 2 is a perspective view of the lock and wing when viewed from the exterior of the wing.
Figure 3:
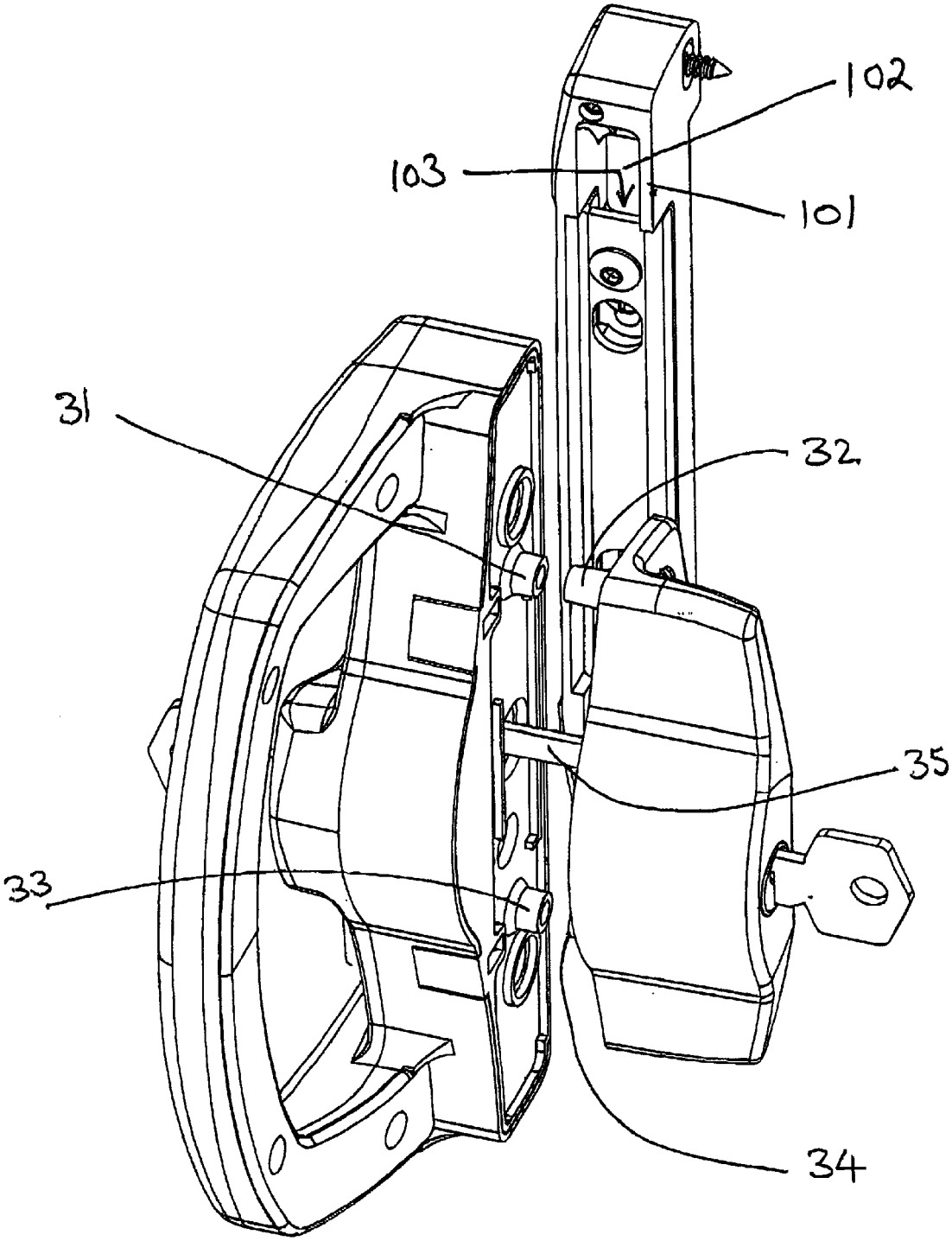
FIG. 3 is a perspective view of the lock without the wing when viewed from the rear of the lock.
Figure 4:
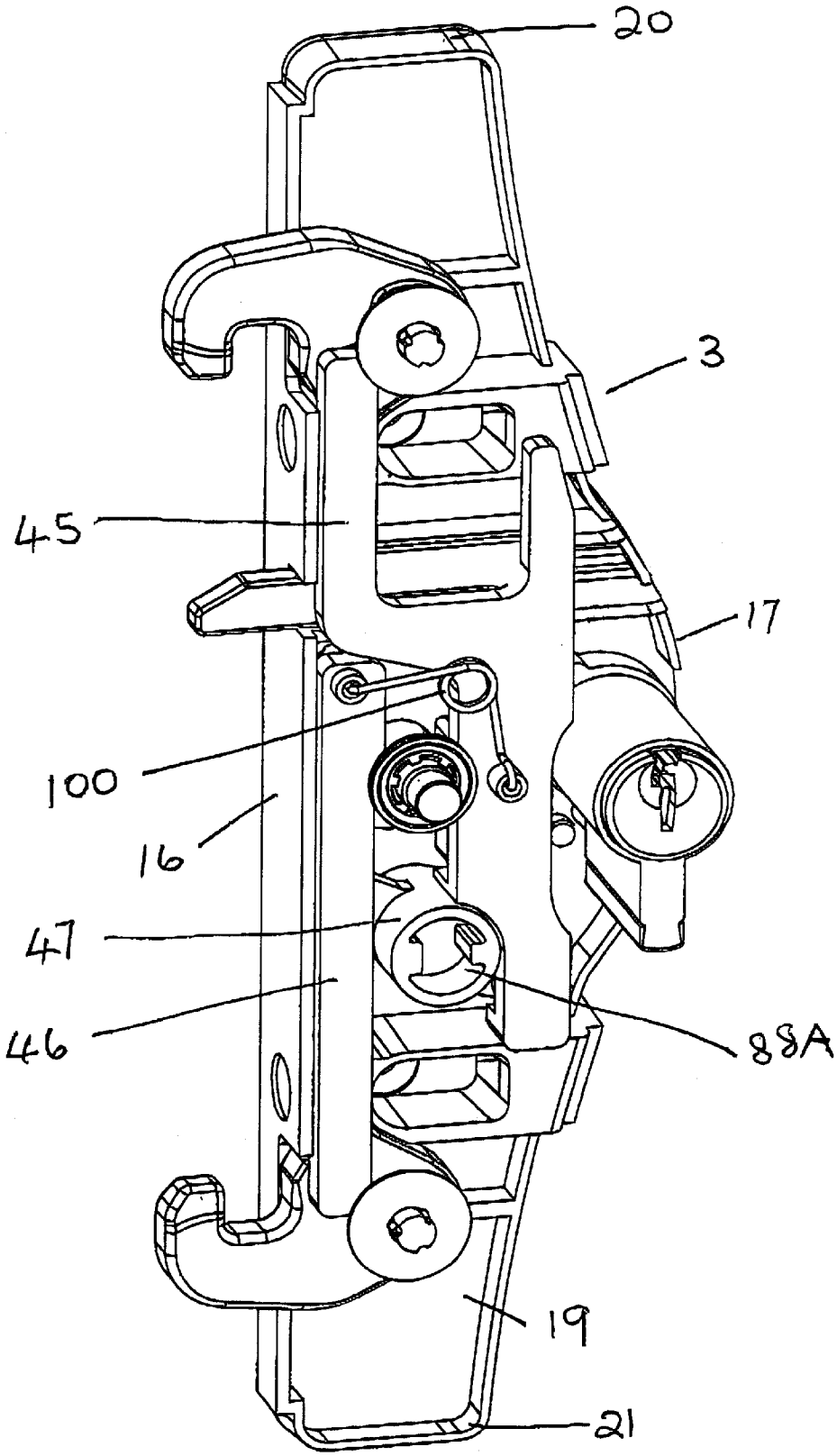
FIG. 4 is a perspective view of the interior lock portion of the manual lock with the lid removed, when viewed from the interior side.

In the preferred embodiment, as shown in FIGS. 1 to 3, the lock body comprises an interior assembly 1 for mounting to the interior surface 2 of a hollow frame element characterized by a hollow portion 2A and in-fill retaining portion 2B, said lock body comprising an interior casing 3, shown in FIG. 4, supporting one but preferably two engaging members; an upper engaging members 4 and a lower engaging member 5, and preferably a hand operable interior-operating member preferably comprising an interior-operating lever 6 by which to displace the engaging members, and electively an interior cylinder 7 having a key operable barrel 8.

The engageable means in preferred embodiments comprises a catch plate 9 engageable by the engaging members 4 and 5. Alternatively, in other embodiments, the engageable means comprises adaption of the element 10 comprising part of the opening to provide engageable shoulders.

In the preferred embodiment shown in FIG. 2, there is mounted to the exterior face of the door an exterior assembly 11, which includes a cylinder 12 having a key operable barrel 13, and an exterior handle 14 by which the wing can be displaced.

The interior assembly, as shown in FIGS. 1, 3 and 4, includes a handle 15, preferably a D-shaped handle, by which the wing can be displaced. The interior casing 3 is defined by a front wall 16 disposed towards the catch plate 9, an opposed rear wall 17 an outer side comprising a casing lid 18, shown in FIG. 11, to which the handle 15 is integrally connected, an opposed underside 19 adjacent to the interior surface 2 of the frame, a top, (or upper) wall 20 and a bottom, (or lower) wall 21 which in turn define the positional prepositions.

Figure 9:
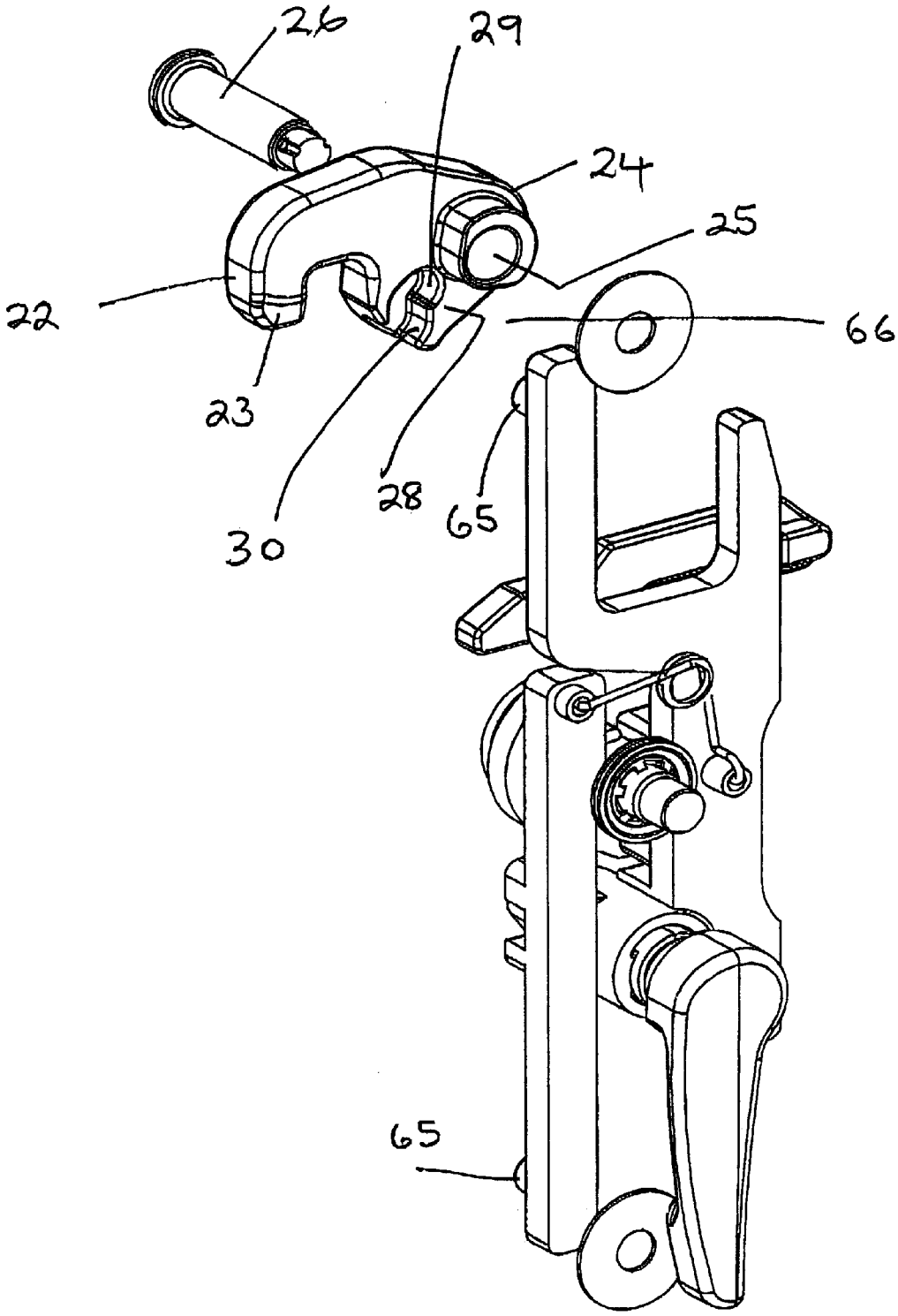
FIG. 9 is a perspective, partially exploded partial view of the interior lock portion of the manual lock with the lid removed and casing removed, when viewed from the interior side.
Figure 11:
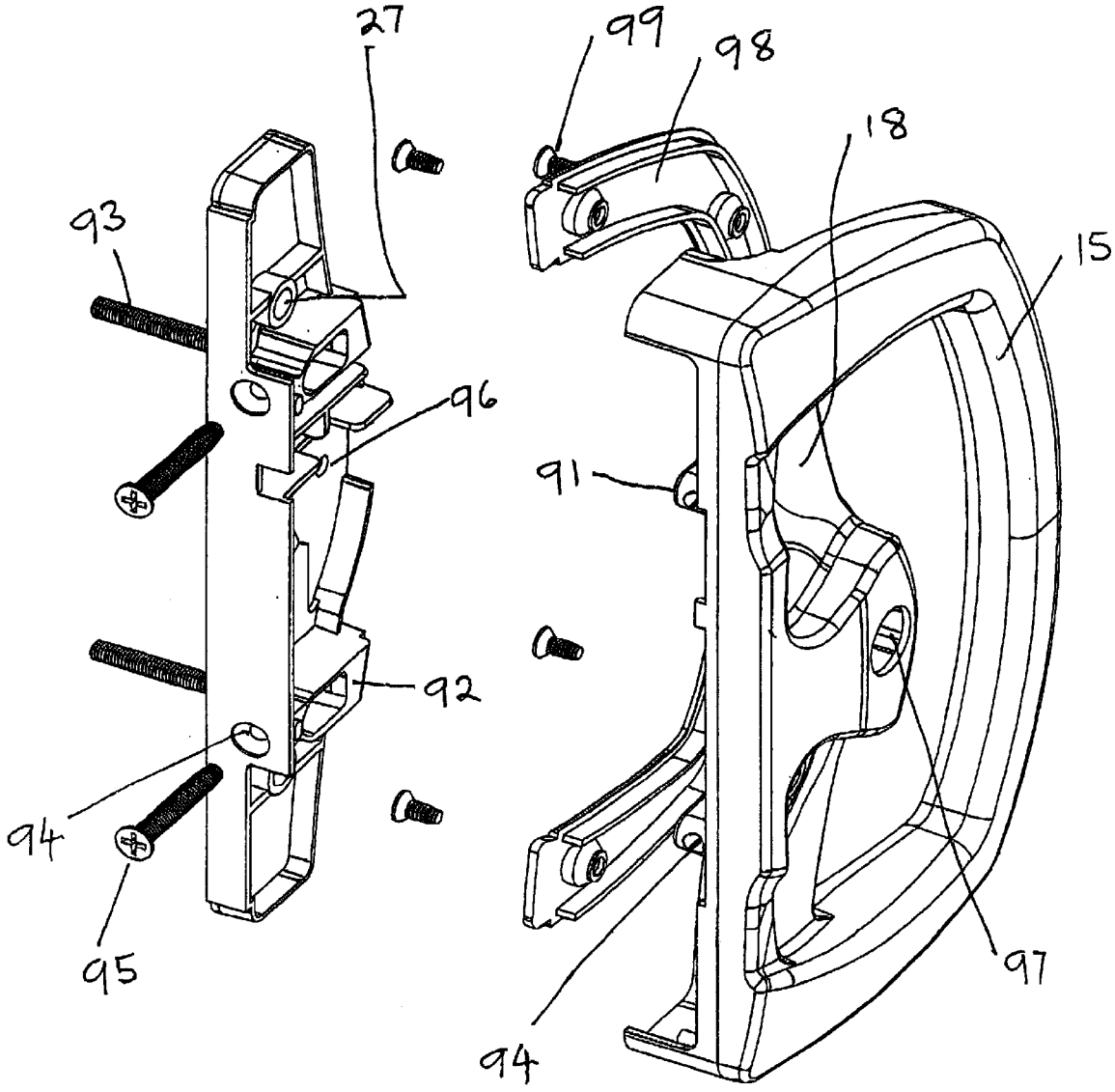
FIG. 11 is a perspective view of the interior casing, lid and handle, when viewed from the interior side.

The interior assembly, as shown in FIG. 4 and 9, comprises the upper and lower engaging members 4, 5 respectively, each having a free end 22 with each free end having an engaging element that in preferred embodiments comprises a hooked portion 23 but in other embodiments comprises sideways protruding shoulders. Each engaging member has an opposite supported end 24 supported in the casing at a pivotal axis 25 defined by a substantially cylindrical shaft preferably comprising a steel rivet 26, which has passage through, to be supported by, an aperture 27 in the casing, as shown in FIG. 11—the rivet being coaxial with the axis of rotation of the engaging member and preferably substantially orthogonal to the surface of the wing.

In preferred embodiments, as shown in FIG. 9, each engaging member has a slotted recess 28 adjacent to but radially disposed from the pivotal axis 25 which in a first part 29 is substantially radial to the axis of rotation and in a second part 30, (which may be curved), has an operative portion which is inclined to the vertical when the engaging member is retracted, undisplaced and which is substantially vertically disposed when the engaging member is extended.

In preferred embodiments of the manual lock, the lock only requires three through apertures in the wing to accommodate bosses, as shown in FIG. 3, that are spaced at the distances commonly employed for glass patio doors—this distance being approximately 82 mm. The upper aperture in the wing accommodates bosses 31 and 32 being extensions of the interior and exterior casings respectively, and the lower aperture in the wing accommodates bosses 33 and 34 being extensions of the interior and exterior casings respectively. Fixing screws 93, shown in FIG. 11, having clearance through apertures in the interior bosses pass through the wing to engage in threaded recesses in the exterior bosses. A central aperture provides passage for a first-spindle 35, the only member operably connecting the cylinder 12 in the exterior assembly to the interior assembly 1 of the basic manual lock.

Figure 5:
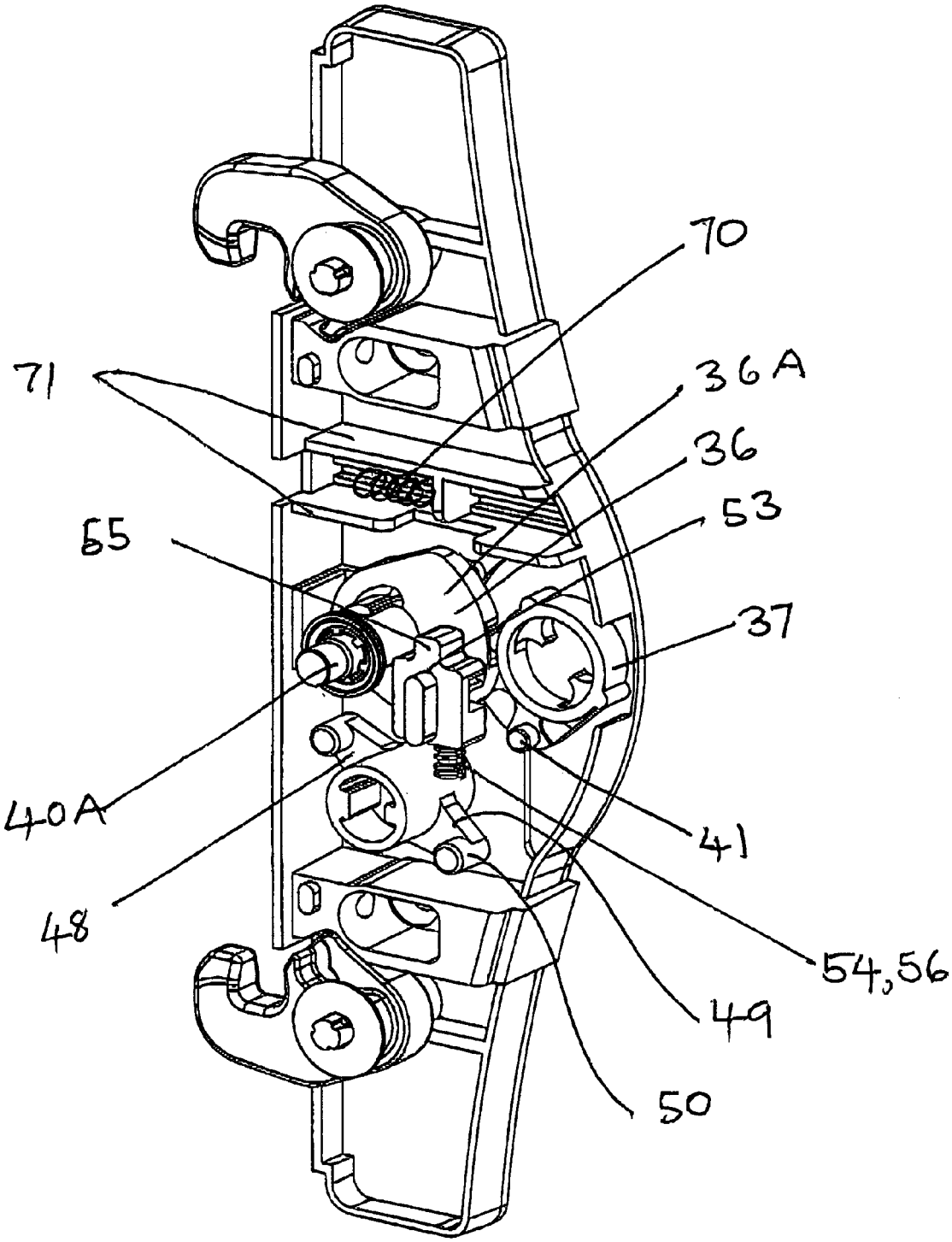
FIG. 5 is the view of FIG. 4 with the lid and slides removed.
Figure 6:
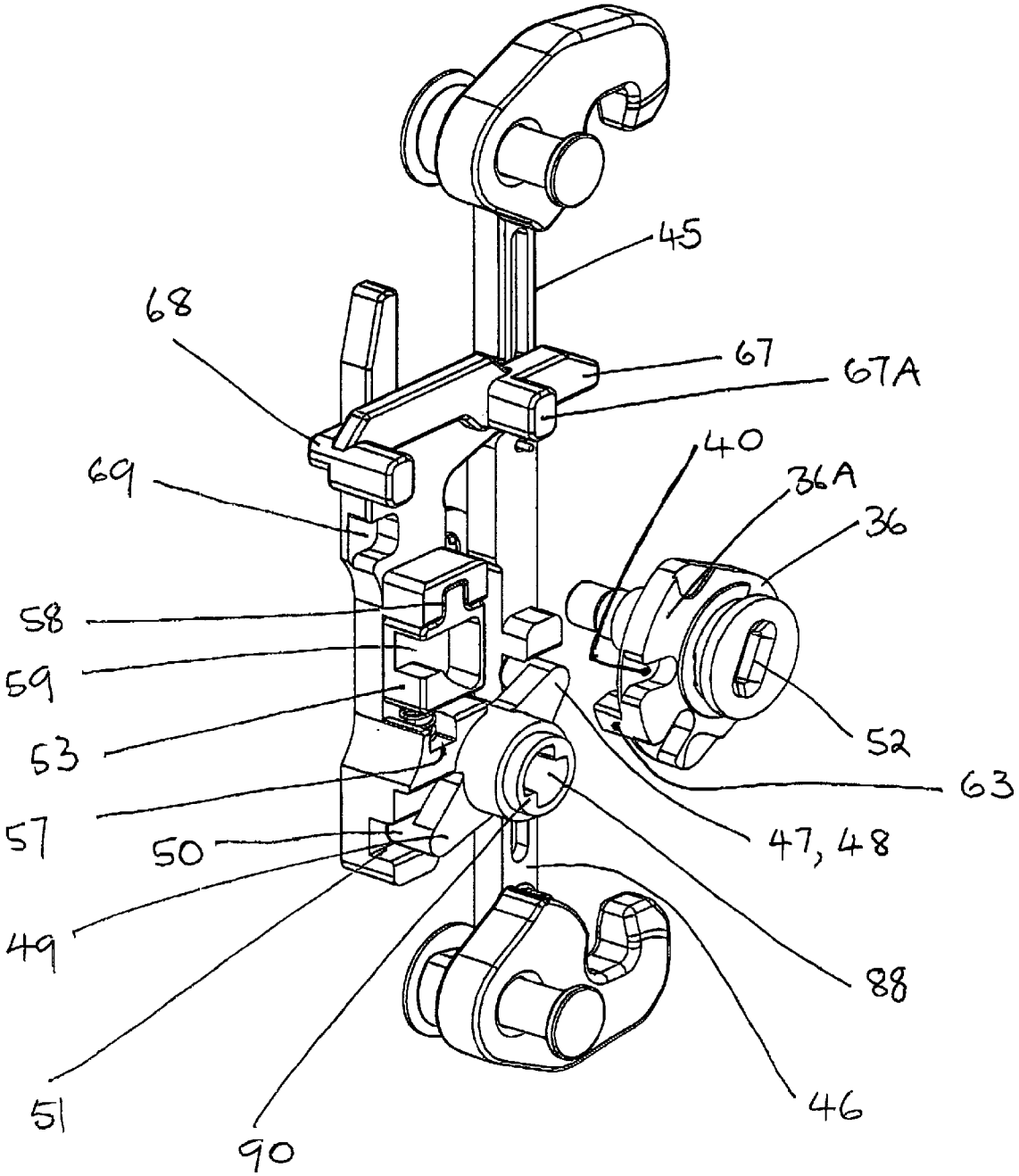
FIG. 6 is a perspective view of the interior lock portion of the manual lock with the lid and casing removed, when viewed from the exterior side.
Figure 7:
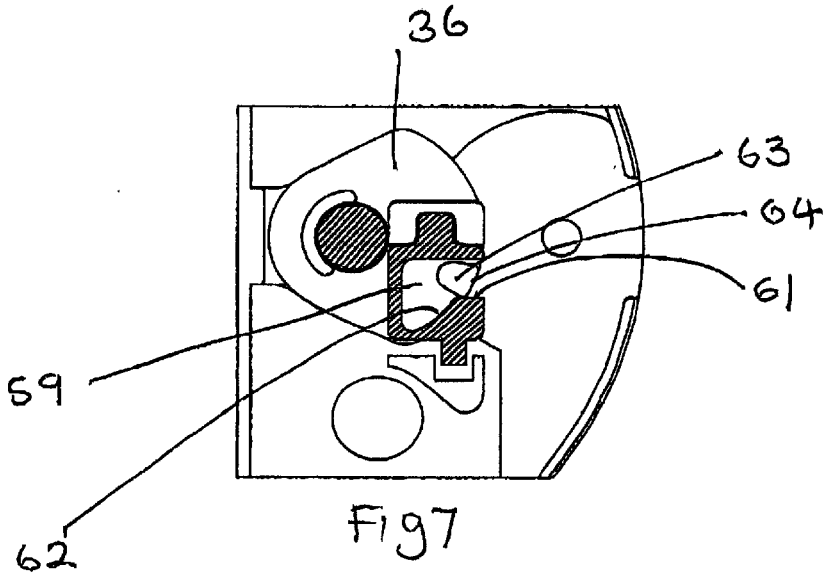
FIG. 7 is a schematic, partial side view of the sub-slide and first pinion when the sub-slide is relatively undisplaced.
Figure 10:
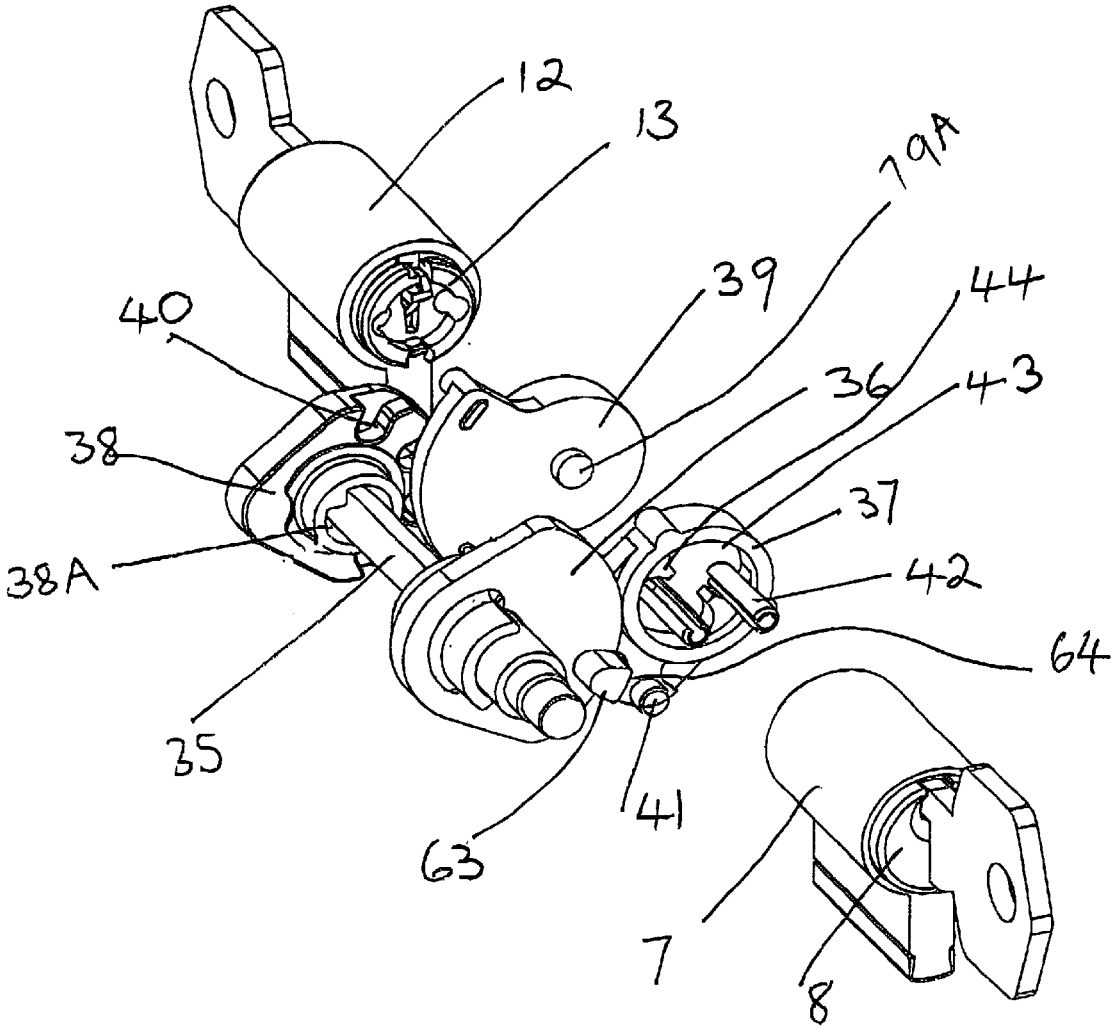
FIG. 10 is a perspective, partially exploded partial view of the pinions, first-spindle and cylinders when viewed from the interior side.

Supported within the interior casing by a circular aperture in the interior casing underside 19, is an angularly displaceable first pinion 36, as shown in FIGS. 5, 6 and 10, comprising a disc-like portion 36A having an axis of rotation orthogonal to the surface of the wing and having substantially parallel sided drive slots 40 radially disposed from the axis of rotation of the first pinion, each having a profiled opening. The first pinion has a shaft-like axial extension 40A supported in a recess in the underside of the casing lid 18.

This first pinion is directly angularly coupled, without free movement, to an adjacent, overlapping second pinion 37, (supported by a shaft-like axial extension housed in a recess 96 in the underside of the interior casing, as shown in FIG. 11), the second pinion 37 being supported coaxially with barrel 8 of the interior locking cylinder 7 with which the second pinion 37 is coupled with free movement, and by which the second pinion is supported adjacent to the internal underside 19 of the casing. The second pinion has sideways protruding drive pins 41 radially disposed from the axis of rotation of the second pinion and configured such that at any one time there is at least one drive pin 41 within a drive slot 40 and where angular displacement of either drive pin 41 or slot 40 causes a corresponding angular displacement of the other and so in this respect, acting similarly to meshed helically geared pinions. The first pinion has on the underside, as shown in FIG. 6, a slotted recess 52 in which the first-spindle 35 engages without significant free movement—preferably in splined engagement to accommodate a variety of distances between the interior and exterior assemblies.

As shown in FIG. 10, the first pinion 36 is coupled by the first-spindle 35 to a spindle pinion 38 within the exterior casing comprising a disc-like portion having an axis of rotation orthogonal to the surface of the wing and having substantially parallel sided drive slots radially disposed from the axis of rotation of the first pinion, each having a profiled opening. The spindle pinion is directly coupled to an adjacent offset pinion 39 supported in the exterior casing coaxially with barrel 13 with which it is directly coupled without free movement, and by which the offset-pinion is supported adjacent to the lid 74 of the exterior casing. The second pinion has sideways protruding drive pins disposed from the axis of rotation of the second pinion and configured such that at any one time there is at least one drive pin within a drive slot and where angular displacement of either the drive pin or drive slot causes a corresponding angular displacement of the other.

The first and second pinion and first-spindle 35 comprise a directly coupled angularly displaceable first transmission train that is coupled with free movement to the third and offset pinion and exterior barrel, which together comprise a directly coupled second transmission train. The first transmission train is characterized by an "undisplaced configuration" corresponding to retracted engaging members and a "latched configuration" corresponding to extended engaging members and a "first locking configuration" also corresponding to extended engaging members. This will be explained below.

The barrel in the interior cylinder can be rotated from an "undisplaced position" defined as the key removal position, to positions causing the first transmission train to rotate between configurations and then be returned to the barrel undisplaced position.

The second transmission train, including the exterior barrel can be rotated from an "undisplaced configuration" to cause the first transmission train to angularly displace between its respective configurations and then returned to the undisplaced configuration. As can be seen from FIG. 10, the rectangular shaped first-spindle locates in a shouldered cylindrical recess 38A in the underside of the spindle pinion to provide coupling with free movement between the two.

It should be observed that the inclusion of the pinion trains enables the key apertures in the barrels to be positioned an extended distance from the front edge of the lock to provide greatly improved accessibility to the key aperture.

The free movement referred to above between the interior barrel and the adjacent pinion, (common to many security door locks), enables the key to be inserted in the barrel when the barrel is undisplaced, the key and barrel to be rotated to operate the first transmission train from the undisplaced configuration to the latched configuration and then the key turned a further small amount to lock the lock to the first locked configuration by displacing the sub-slide. The key can then be reversed to the undisplaced barrel position to enable the key to be removed, while leaving the transmission train in the locking configuration. The free movement between the first-pinion 35 and recess 38A is configured such that if the first transmission train is undisplaced then any movement of the second transmission in a locking/latching direction immediately causes the first transmission train to commence displacing, and if the first transmission train is in the first locking configuration then any movement of the second transmission in an unlocking/unlatching direction immediately causes the first transmission train to commence displacing towards the undisplaced configuration.

In preferred embodiments, diagonally opposed barrel pins 42 protrude longitudinally from the interior barrel internal end to locate in respective arcular recesses 43 in the second pinion said recesses being defined by substantially radial shoulders 44 which are engageable by the barrel pins. Diagonally opposed barrel pins 42 also protrude longitudinally from the exterior barrel internal end to locate in cylindrical recesses in the offset pinion.

Supported within the interior casing, as shown in FIGS. 4 to 6, are two rectilinearly vertically displaceable counter-acting slides; an upper slide 45 and a lower slide 46 between which there is an angularly displaceable rocker 47 by which the two slides are coupled so that each displaces equally and simultaneously but in the opposite direction. These slide are supported by vertically elongated finned portions of the casing and the lid 18 and the front wall. The rocker 47 has in relation to its axis of rotation, diagonally opposite arms, a forward protruding rocker arm 48 which straddle the lower slide 46 and a rearward protruding rocker arm 49 which straddles the upper slide 45, the arms being coupled to the respective adjacent slide by a sideways protruding rocker pin 50 which locates in a horizontally elongated slide slot 51 in the slide—the protrusions preferably comprising cylindrical protrusions having a longitudinal axis parallel with that of the rocker and barrels. The interior operating member 6 is connected to the rocker 47 by a shaft that meshes, (i.e. engages without free movement), in the axial rocker recess 88A—the shaft preferably being an extension of a shaft portion of the interior-operating member.

The upper slide 45, as shown in FIGS. 5 to 8, supports on the underside a relatively moveable spring biased sub-slide 53 that is biased towards an undisplaced position relative to the upper slide by a spring 54. The sub-slide has upper and lower extensions 55, 56 respectively, which locate in slotted recesses 58, 57 respectively in the underside of the upper slide and by which the sub-slide is supported adjacent to the first pinion.

In the underside of the sub-slide disposed towards the first pinion is a concave cam recess 59 defined by an upper or first drive shoulder 60 and a lower or second drive shoulder 61 between which a third shoulder 63 of the first pinion locates to couple the upper slide and therefore the rocker and lower slide, to the first transmission train. In alternative embodiments, the upper shoulder comprises part of the upper slide, (or the support slide described below), and the lower drive shoulder comprises part of the sub-slide and is relatively displaceable.

Because of the coupling, the upper slide, from a nominal undisplaced position corresponding to retracted engaging members, can be displaced by cylinder or lever 6 operation to a position corresponding to the latched configuration with extended engaging members. While unlocked, the first transmission train, ("first train"), can cause the upper slide, rocker and interior operating lever to correspondingly rotate and the operating lever can cause the rocker, upper slide and first train to correspondingly rotate and so the first train is moveable in either angular direction, towards and from the latched configuration, by either a key or the operating lever.

Figure 8:
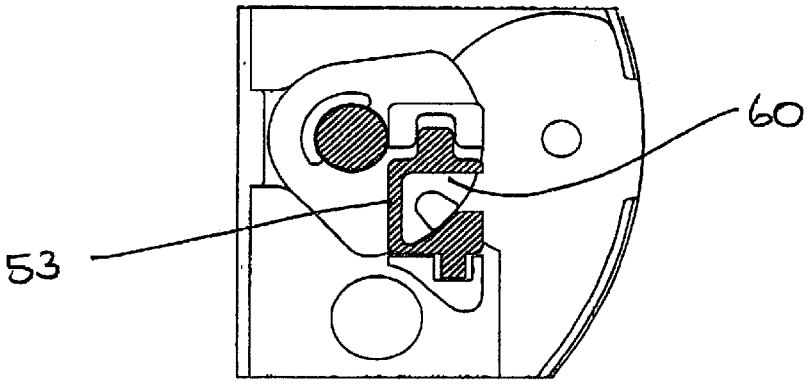
FIG. 8 is a schematic, partial side view of the sub-slide and first pinion when the sub-slide is fully displaced and the third drive shoulder abuts the exit shoulder.
Figure 16:
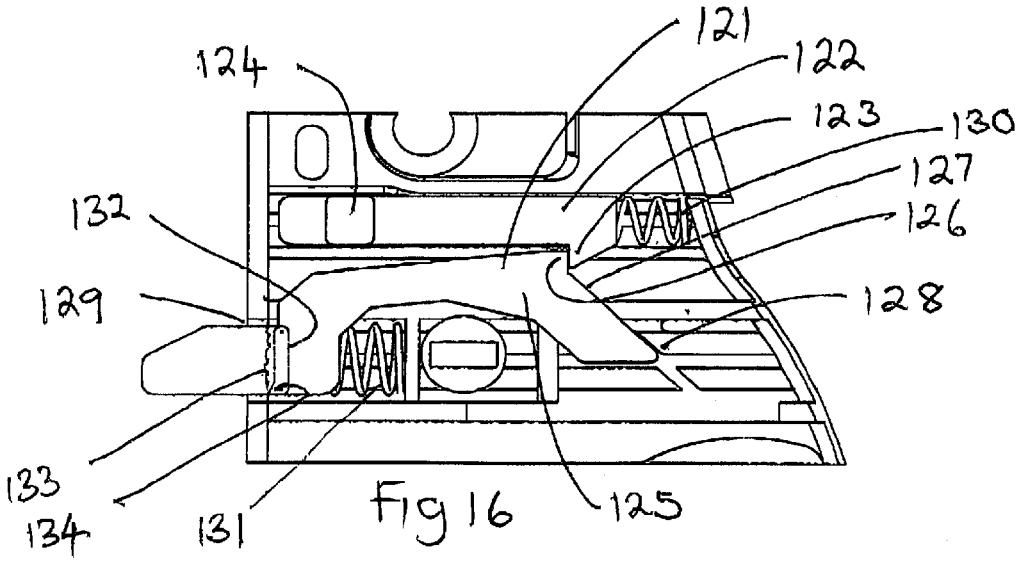
FIG. 16 is a schematic side view of the plunger for the self-latching lock

When the lock is in the latched configuration, as shown in FIG. 8, the first train can be further displaced in a locking direction to displace the sub-slide relative to the upper slide, against spring biasing means while the upper slide remains substantially unmoved, to lock the lock in the first locked configuration—this can be done by turning the key in either cylinder.

In preferred embodiments the sub-slide can only be displaced against the spring a pre-determined distance relative to the upper slide, this distance being defined by a shoulder portion adjacent to the recess 57 which acts as a sub-slide stop. Only when the upper slide is fully displaced downwardly to the latching configuration and the sub-slide has been displaced to be adjacent to the sub-slide stop can the shoulder 63 be rotated to depart from the recess between the drive shoulders 60 and 61.

In this locked configuration there is no coupling between the first train and interior-operating member and slides and the interior-operating member cannot be rotated to cause the slides to displace to cause the pinions to rotate—in this configuration the upper slide is rendered immovable by shoulder 63 in cooperation with an arcular exit shoulder 62 of the sub-slide the surface of which then lies substantially orthogonal to the pivotal axis of the first pinion. In this configuration a leading edge 64 of the shoulder 63 preferably comprising an arcular edge, (with respect to the axis of rotation of the first pinion), abuts the exit shoulder having been displaced from between the drive shoulders to slide over the exit shoulder 62 without moving the support slide. Attempted displacement of the upper slide upwardly causes the sub-slide to be urged upwardly to cause the surface of the exit shoulder to exert a force on the shoulder 63 which is defined by a vector passing through the pivotal axis of the first pinion without giving rise to a moment on the first pinion.

The upper slide 45, as shown in FIGS. 6 and 9, extends from the rocker 47 to connect to the upper engaging member 4; the lower slide 46 extends from the rocker 47 to connect to the lower engaging member 5. Each slides has a sideways protruding slide pin 65 that locates in a slotted recess 28 in the associated engaging member the—pin and slotted recess being coupled in cam-follower relationship.

As each slide pin drives the associated engaging arm to the extended position, it slides within the first part 29 in a manner defined by a slide-follower relationship. When the engaging members are in the fully extended positions, (in a preferred embodiment disposed 90 degrees to the side of the interior casing), the slide pin displaces further to deadlock the engaging member in which position the slide pin abuts the operative position of the second part 30 of the slotted recess which is then vertically disposed. The significance of the operative position being vertical when the engaging members are extended is that attempted rotation of the engaging arm from the extended position causes the wall of the second part 30 of the slotted recess to exert a horizontal force on the slide pin which is resisted by the wall of the interior casing and rotation of the engaging member is prevented, the arrangement in effect deadlocking the engaging member.

In a preferred embodiment the engaging members, have drive portions 66 mirror images about a horizontal line through the first pinion, these portions including the recesses 31.

Preferably, the interior assembly includes a detent including a plunger 67, as shown in FIGS. 4, 5 and 6, supported between horizontally elongated finned portions 71 of the casing and outwardly biased by spring 70 which abuts an inwardly protruding shoulder 67A of the plunger 67 and which is also supported between the horizontally elongated fins 71, as shown in FIG. 5. The plunger has a side protruding shoulder 68, which can locate in an underside detent recess 69 in the upper slide to restrain the upper slide from displacing from the position corresponding to retracted engaging members. The lock is configured such that when the upper and lower slides are undisplaced, i.e. the engaging members are retracted, the plunger protrudes from the interior casing while the shoulder 68 is within the detent recess 69 restraining the upper slide and therefore restraining the directly coupled further mechanism from being displaced from the undisplaced configuration. Depression of the plunger, through engagement with the catch plate as the wing is closed causes displacement of the shoulder 68 from the detent recess 69 enabling the slides to be displaced.

The engaging members are configured so that they move simultaneously in opposite directions and in the direction of the hooks. In a preferred embodiment they move towards each other and the hooked portions move towards each other to be engageable behind shoulders of the catch plate.

Figure 12:
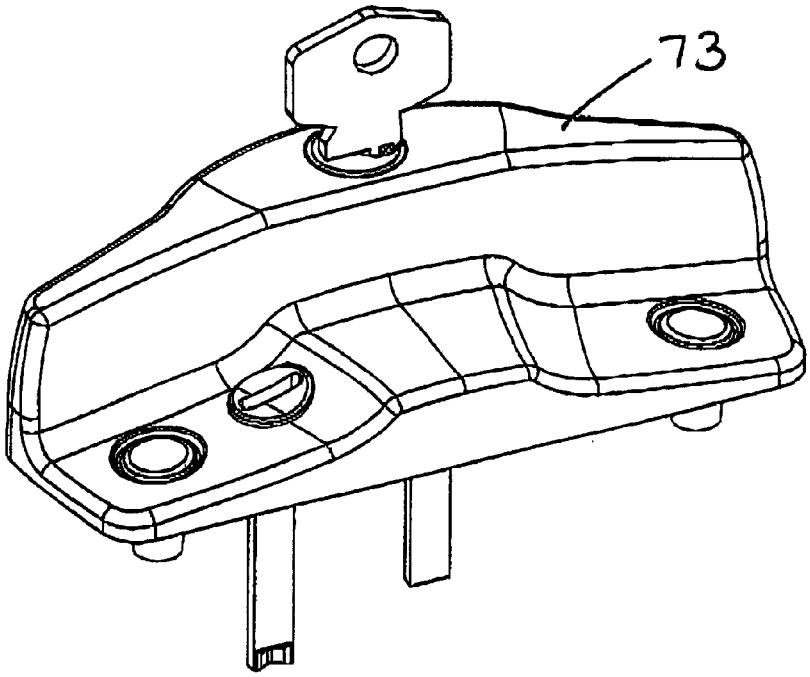
FIG. 12 is a perspective view of the exterior handle of the manual lock, exterior-latching member and first-spindle and second-spindle, when viewed from the exterior side.
Figure 13:
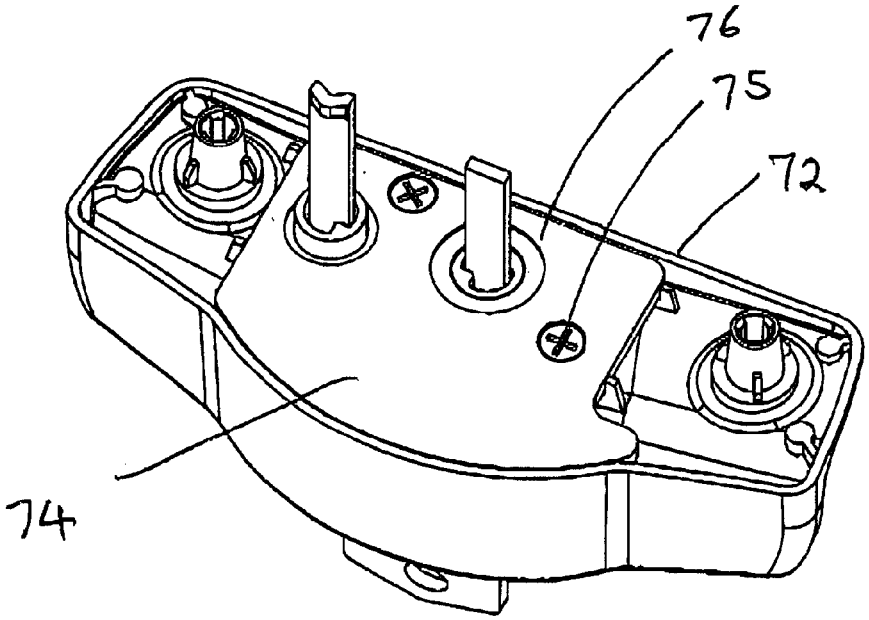
FIG. 13 is a perspective view of the exterior handle of the manual lock and first-spindle and second-spindle, when viewed from the underside side of the external handle.
Figure 14:
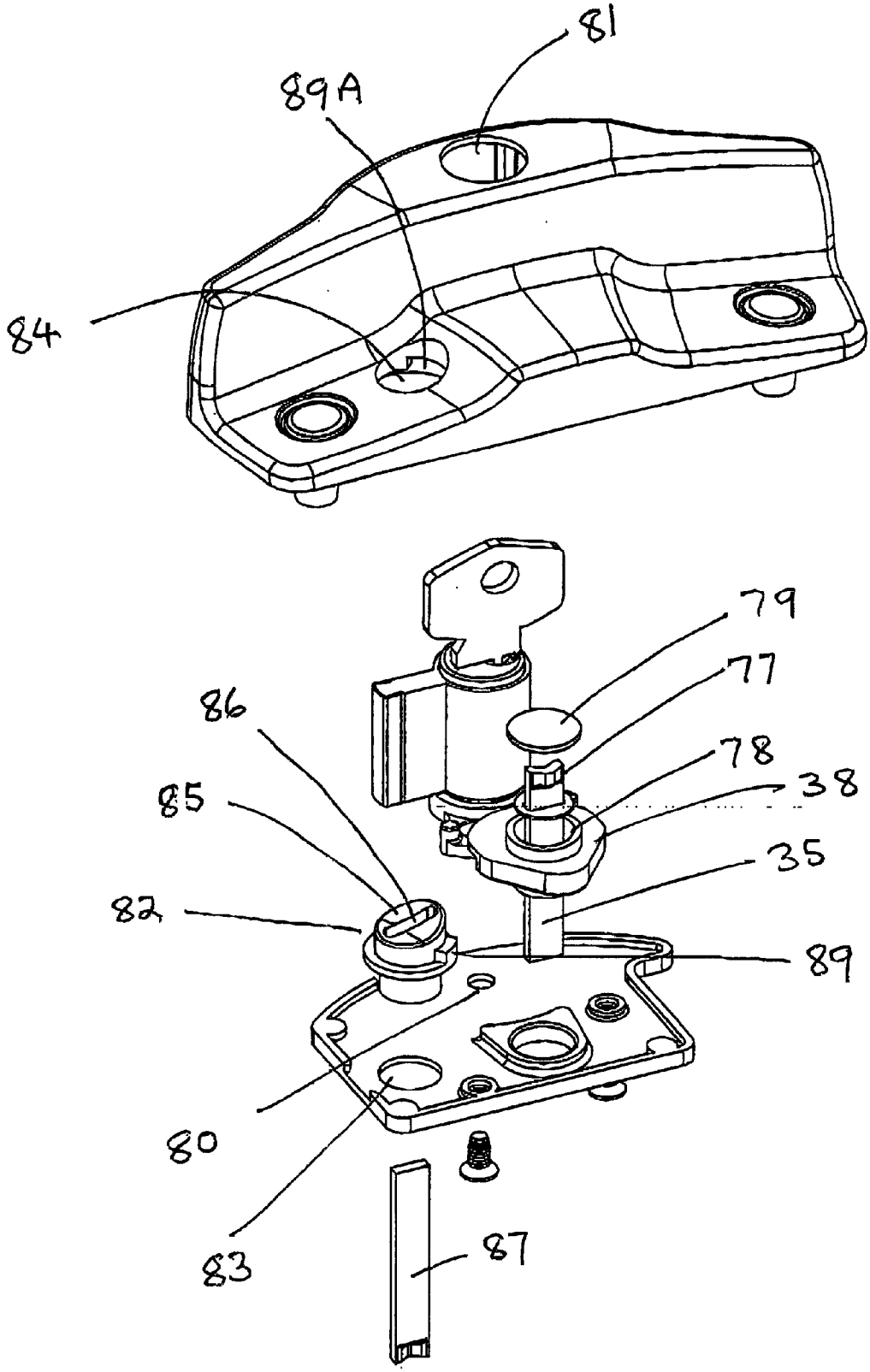
FIG. 14 is an exploded view of the exterior handle of FIG. 12.

The exterior second assembly, as shown in FIGS. 12 to 14, preferably comprises a hollow shaped exterior casing 72 of which the exterior handle 73 is an integral part and an underside exterior lid 74 attachable by removable screws 75—the lid having an aperture 76 through which the first-spindle 35 has passage and by which the spindle-pinion 38 is supported. The first-spindle meshes, (i.e. engages without free movement), within an axial aperture 78 in the spindle pinion and has a headed portion 77 preventing it from leaving the exterior assembly. Directly above this head is a hardened steel disc 79 to protect the third cam from external attack through the adjacent to casing wall. The offset pinion is supported adjacently by a shaft-like protrusion 79A, as shown in FIG. 10 that locates to be supported in the aperture 80 in the exterior lid 74. There is a cylinder recess in the casing that connects to the aperture 81 is the exterior casing and through which the cylinder barrel head protrudes to be accessible.

In alternative preferred embodiments of the manual lock, the exterior assembly includes an angularly displaceable hand operable member for displacing the engaging members to the latched configuration. It preferably comprising a exterior-latching member 82 supported between an aperture 83 in the lid 74 and an aperture 84 in the casing through which a head portion 85 is accessible to be operable. Preferably this head portion has an accessible slotted recess 86 to accept a key or other tool. The exterior-latching member has on the underside another slotted recess which meshes with a second-spindle 87, said second-spindle having passage through a fourth aperture in the door to locate in aperture 88, as shown in FIG. 6, in the underside of the rocker. The exterior-latching member has a sideways protruding shoulder comprising stop 89 that locates in an arcular recess 89A coaxial with the latching-lever and in which the stop shoulder can freely rotate between limits defined by radial shoulders that define the limits of the arcular recess.

The stop 89 and arcular recess are configured such that when the slides are in the undisplaced configuration and the exterior-latching member, (and second-spindle), is in an undisplaced configuration, the stop abuts one end of the arcular recess, and from this position the exterior-latching can be rotated to drive the second-spindle to cause the rocker to displace to the position corresponding to the latched configuration of the lock and then the exterior-latching member can be returned to the undisplaced position, (and no further) while leaving the lock in the latched configuration. Because of the limits set on rotation of the latching exterior-member by the radial shoulders, it cannot be rotated to displace the lock from the latched configuration.

The aperture 88 in the rocker has two inwardly protruding opposed longitudinally shoulders 90 defining two opposed arcular recesses in which the blade-like second-spindle 87 can rotate with free movement. Each shoulder is configured such that the undisplaced position of the second-spindle corresponds with the second-spindle being adjacent to a first side of each shoulder 90 from which the second-spindle can be rotated to urge each first shoulder to rotate to cause the rocker to displace to the latched position—the exterior-latching member can then be rotated to the undisplaced position without engaging an opposed other, second side of each shoulder 90 to cause the rocker to rotate.

The interior handle, as shown in FIG. 11, preferably comprises a lid portion 18 of the interior casing having an upper and lower inwardly protruding boss 91 each locating in a shouldered recesses 92 in the interior casing that is located substantially co-axially with the fixing screws 93. The shouldered recess 92 and the boss 91 are together intersected by a transverse recess 94 through which a transverse screw 95 has passage to fasten the boss 91 within the recesses 92 by which it is preferably surrounded. When the door is closed these screws 95 are inaccessible. The boss 91 preferably comprises a horizontally elongated protruding oval blade.

The second pinion is supported in the interior casing by a shaft-like protrusion that locates in the recess 96. Supported between this pinion and a cylinder recess in the lid portion 18 is the exterior cylinder 12. The cylinder recess connects to a barrel aperture 97 in the wall of the lid through which the head of the interior barrel 8 protrudes to be accessible. Preferably the handle 15 comprises an outer portion generally hollow in form and a handle back 98 which is attached by screws 99 to the outer portion.

Where either cylinder is omitted, exteriorly or interiorly, a plug is preferably employed to occupy the cylinder space: to protect the associated pinion from tampering, to support the pinion, and to improve the appearance which otherwise would be compromised by a visible aperture.

The manual lock preferably includes a torsion springs 100, as shown in FIG. 4, having arms which attach to, to act on each slide to urge the upper and lower slides simultaneously towards their extreme outwardly disposed or inwardly disposed limits of displacement. In so doing, acting as an over-centre device.

Figure 15:
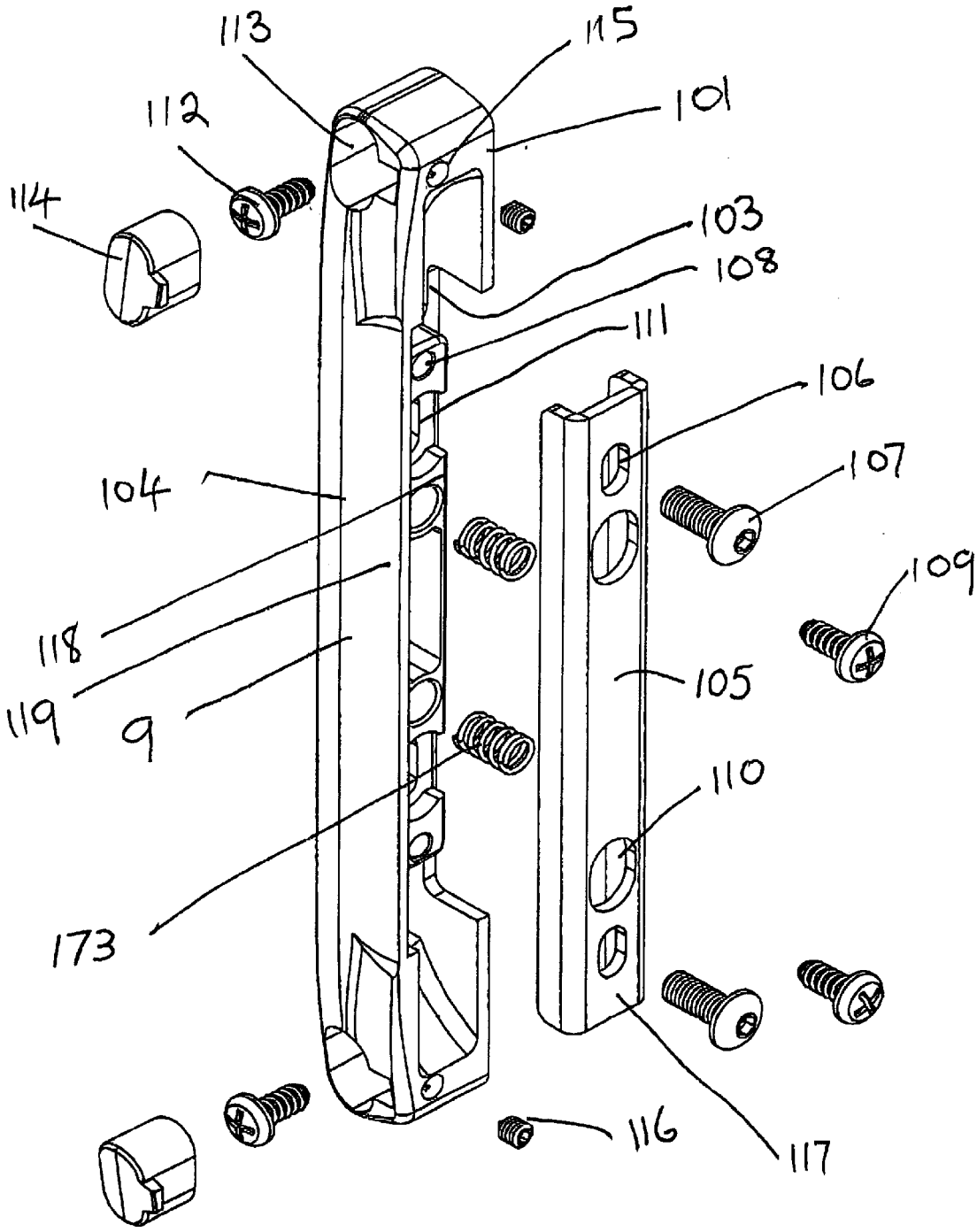
FIG. 15 is a perspective, exploded view of the catch plate, when viewed from the interior and rear.

The catch plate 9, as shown in FIGS. 3 and 15, has a forward wall 101 disposed towards the front edge of the interior assembly with openings 102, as shown in FIG. 3, to provide passage for the engaging members to recesses 103 into which the hooked portion of the engaging arm extends. The catch plate preferably comprises a vertically elongated catch casing 104 which supports a forward wall comprising a separate channel 105, restrained relative to the casing by two spaced springs 106 located between the catch casing and channel. There are two spaced vertically elongated apertures 106 in the channel through which headed fasteners preferably comprising screws 107 have passage to attach the channel to the catch casing by engaging in threaded apertures 108 in the catch casing.

Screws 107 are adjustable in an out to selectively set the distance between the channel and catch casing as is required. These screws are used in practice to accommodate small deviations in the closed position of the wing.

The catch casing can be attached to the element defining the wing opening in two different ways: screws 109, including the head can be passed through apertures 110 in the channel to be inserted in vertically elongated first fixing apertures 111 in the catch casing to be fastened to the element 10—the catch plate being vertically adjustable because of the elongation of the fixing recesses. Alternatively, screws 112 may be passed from the outer face of the catch casing through vertically elongated second fixing apertures 113 in the catch casing to be fastened into element 10—the catch plate again being vertically adjusted because of the elongation of the fixing recesses.

After fixing, plugs 114 are inserted within the second fixing apertures. Each second fixing aperture is intersected by transverse apertures 115 commencing at the front edge of the catch casing and support a grub screw 116 which threadedly engage the walls of the recesses. After the insertion of each plug the grub screw is tightened to bite into the plug to retain the plug in the second fixing recesses to render the screw 112 inaccessible.

At each end of the channel is an end shoulder 117 overhanging the recesses 103 to provide in-part a forward wall of the recess 103 and by so doing providing a counterlevered engageable shoulder behind which the hooked portions 23 of the engaging member can locate so that the hooked portion cannot be withdrawn horizontally from behind the shoulder 117—this action corresponding to attempting to open a wing with a latched lock.

Preferably the channel comprises an elongated steel channel. Preferably the casing comprises a single casting to provide increased strength. Preferably the casting comprises a substantially elongated first plate-like portion 118 integrally attached at right angles to another substantially second elongated plate-like portion 119 (corresponding in this embodiment to the base of the casing), each providing for the other a web-like portion to resist bending of the catch casing.

As well as adjustment through elongation of the fixing holes, further adjustment is provided through elongation of the apertures 106 whereby the channel is vertically adjustable up and down from a nominal central position relative to the catch casing. So as the engaging members move to the extended position one of them would contact a shoulder 117 of a misaligned channel and move the channel to be vertically aligned with the engaging members. The springs 106 then maintain the channel relative to the catch casing.

In preferred embodiments of the self-latching lock, as shown in FIGS. 16 to 19, the torsion spring is omitted and the upper and lower slides are biased towards each other by a tension spring 120 having and end connected to each said slide. There is a hand operable exterior-operating member supported in the exterior casing and which is directly coupled without free movement to the rocker, both the rocker and exterior-operating member meshing with opposite ends of an operating shaft—the lock being displaceable to the unlatched configuration by rotation of either operating member.

The self-latching lock has a compound plunger 121 comprising a first plunger 122 supported entirely within the interior casing and having a side protrusion with a substantially vertical shoulder 123 and a detent shoulder 124 identical to shoulder 68. Mounted adjacently and outwardly biased to protrude from the front of the interior casing is a second plunger 125 having a side protrusion with a substantially vertical shoulder 126 disposed towards side shoulder 123 and a downwardly angled tail 127 which is engageable with a horizontal fin 128 emanating from the rear edge 17 of the casing to be displaceable away from the first plunger 122. The leading portion of the second plunger is supported in a casing aperture 129 in the front wall of the interior casing while the tail end of the second plunger is biased towards the first plunger but free to be displaced vertically as occurs through contact with the finned portion 128.

The rectilinearly displaceable spring 130 and first plunger 122 are supported between the horizontally elongated finned horizontal protrusion of the casing 71 and a side wall of the shouldered recess 92 and the spring is located behind the plunger to urge it outwardly. The rectilinearly displaceable spring 131 and a vertically elongated blade-like shoulder 132 that protrudes from the underside of the second plunger are supported between the finned protrusions 71 of the interior casing, the spring locating behind the shoulder 132 to urge it outwardly.

If we consider a lock ready for latching, the second plunger 125 is undisplaced protruding from the casing while being substantially horizontal and shoulder 126 lies adjacent to and forward of shoulder 123. Depression of the second plunger causes shoulder 126 to contact and urge shoulder 123 rearward to release the shoulder 124 from recess 69 to allow the slides to be displaced by spring 120 to cause the engaging members to be driven to the extended position.

Further inward displacement of the second plunger during closing of the wing, causes the tail 127 to slide down the fin 128 to cause the shoulders 123 and 126 to move relatively apart and the shoulder 123 to be released whereupon the first plunger moves outwardly under the action of spring 130 till the shoulder 124 abuts the edge of the upper slide by which it is restrained from displacing further.

During unlatching by interior-operating member 6 or a key, the upper and lower slides are moved to the undisplaced position allowing the first plunger 122 to move forward so that the shoulder 124 enters recess 69 to restrain the slides, (recess 69 in latching embodiments being a little higher up the upper slide than in manual locks). When the wing is subsequently opened, the second slide moves outwardly until shoulder 132 contacts a face portion 133 on the inside of the casing front wall adjacent to the opening 129. This shoulder has at a lower extreme, a forward projecting nib 134 disposed below the longitudinal axis of the spring 131 so that when the nib 134 contacts the face portion 133 a moment is exerted on the second plunger urging it to rotate about the casing aperture 129 and towards the first plunger by which it is restrained. In this configuration the shoulder 126 is disposed forward of shoulder 123 and the mechanism is again ready for latching.

Once the lock is in the latched configuration it can be locked to a second locked configuration by using a key in either barrel to cause a support slide to displace downwardly and it can be locked to a first locked configuration by further rotating the key to displace the sub-slide 53 against biasing means to enable the leading edge 64 to abuts the exit shoulder 62.

Figure 17:
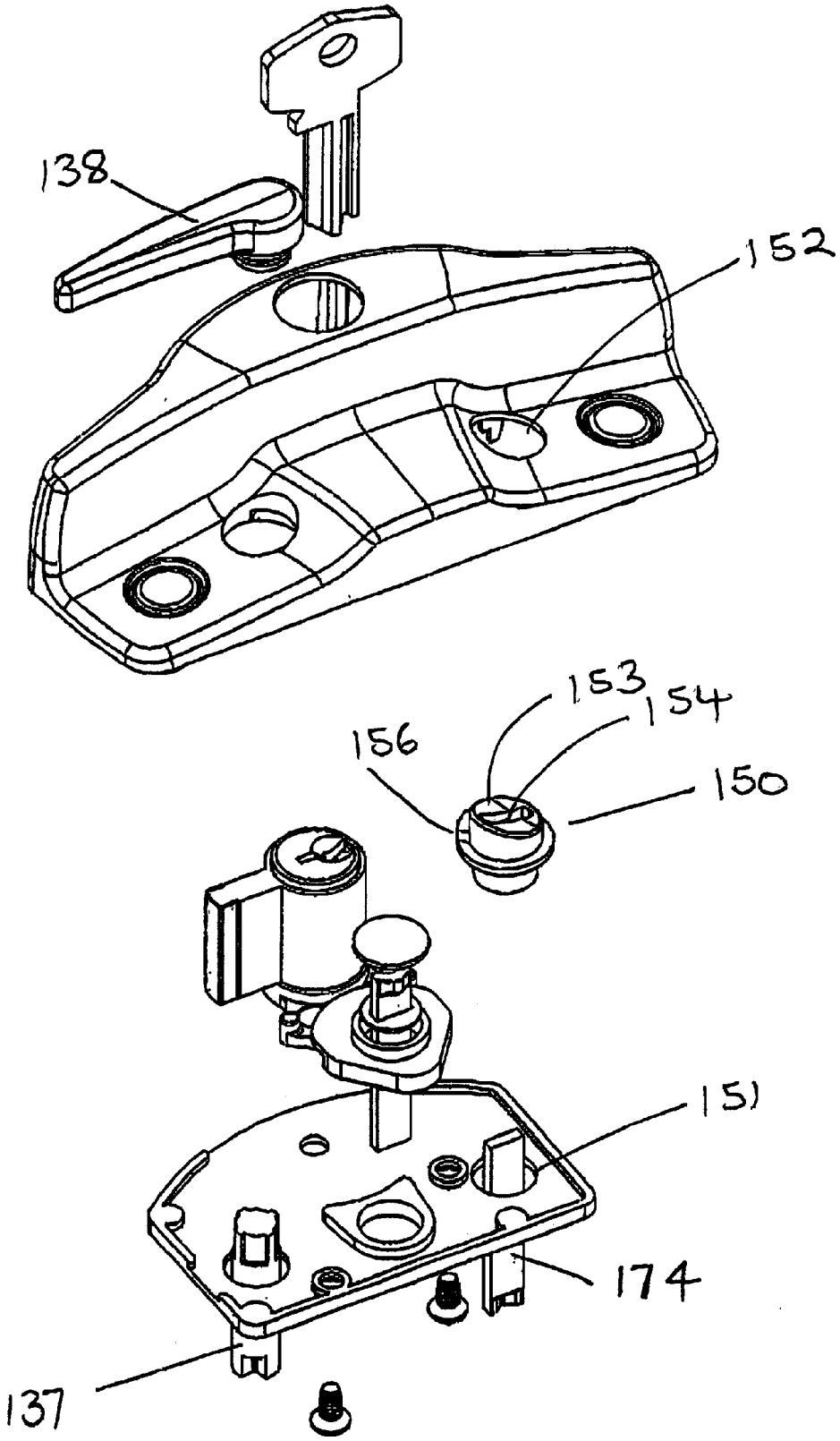
FIG. 17 is a perspective, partially exploded view of the exterior handle of the self-latching lock, the exterior-locking member, the exterior-operating member and first-spindle, second-spindle and third-spindle, when viewed from the exterior side.
Figure 18:
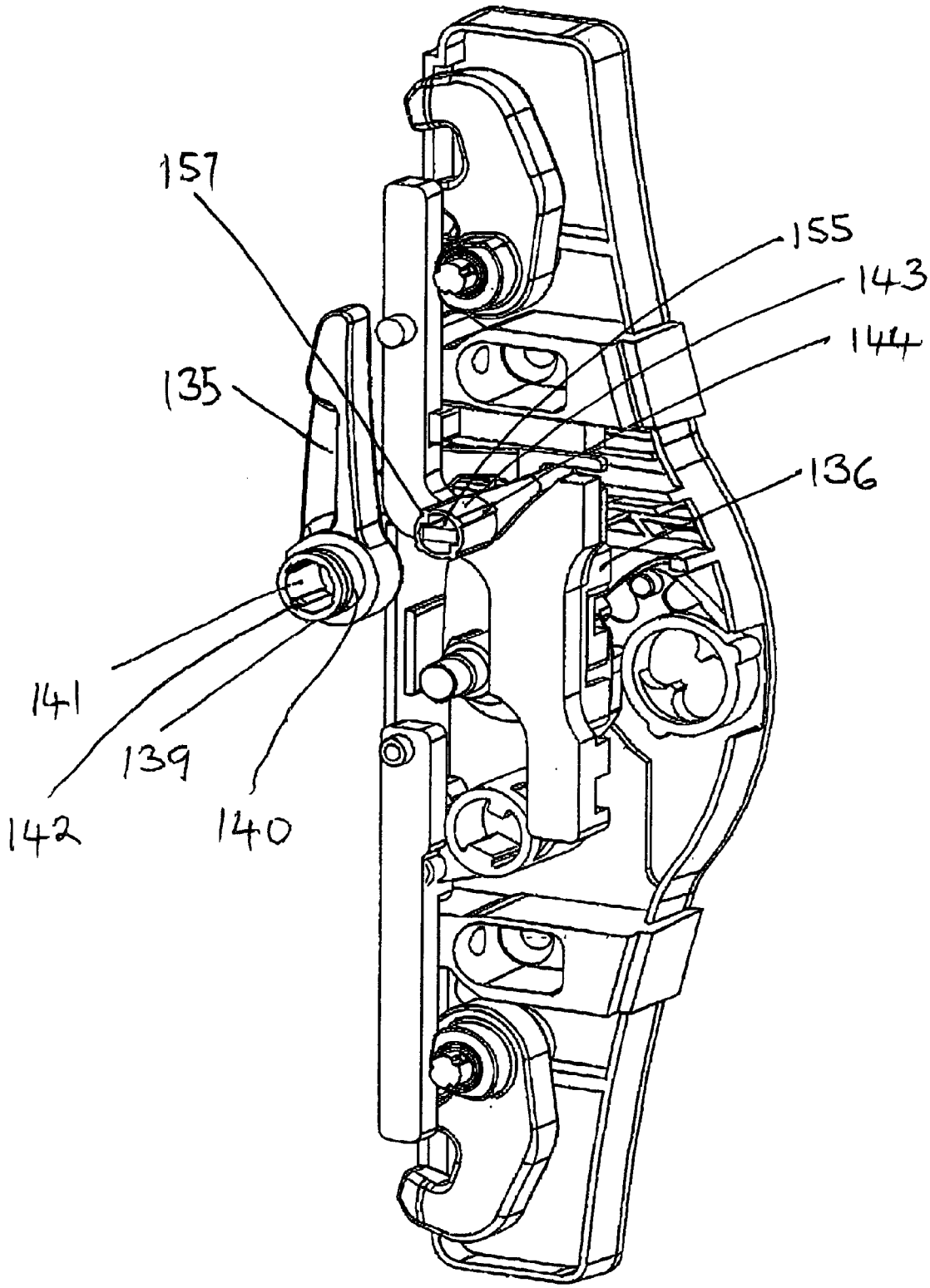
FIG. 18 is a perspective view of the interior lock portion of the self-latching lock with the lid removed, when in the unlocked configuration, when viewed from the interior side with the lever underside outwardly to show the circlip groove.
Figure 19:
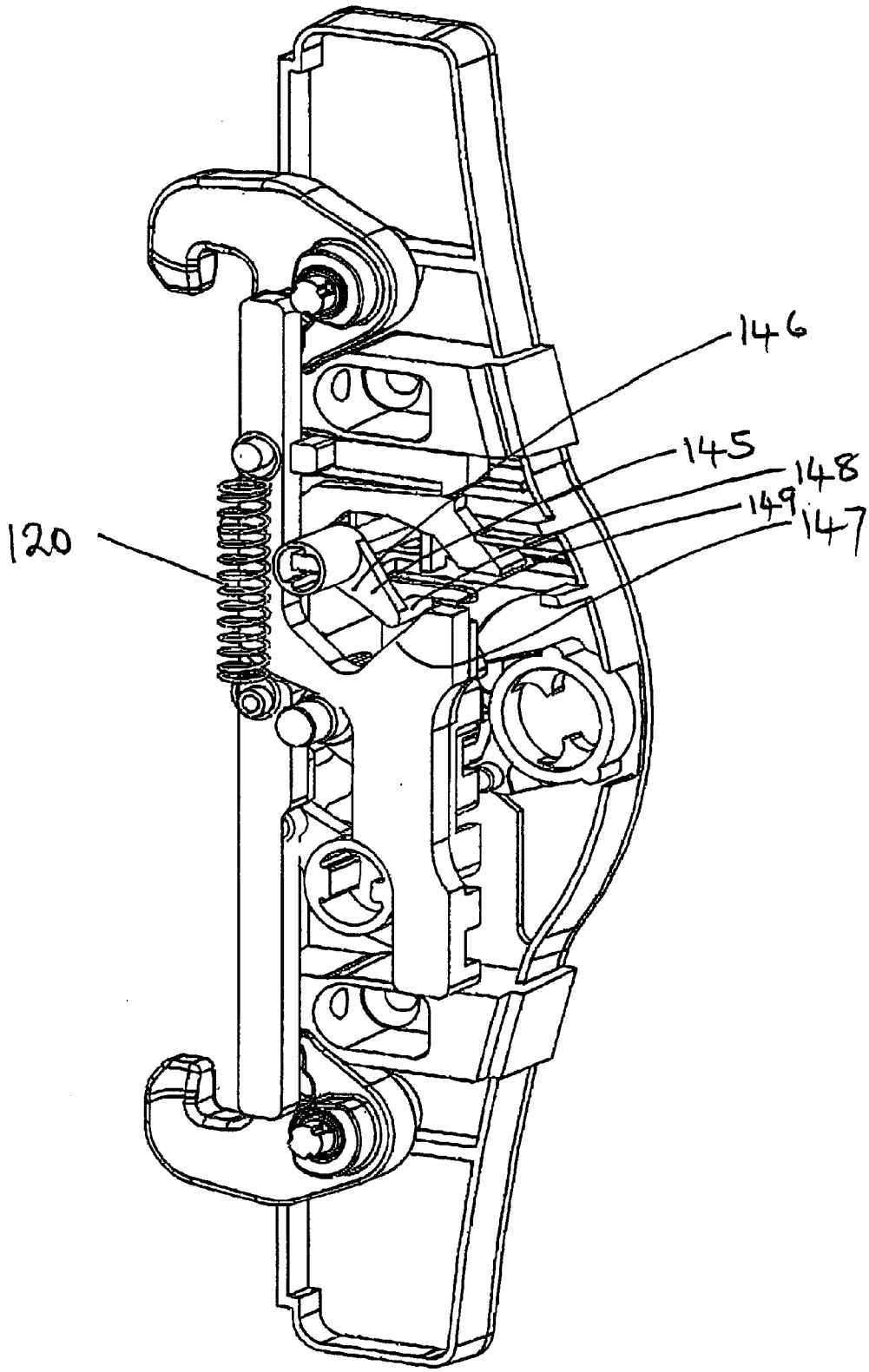
FIG. 19 is a perspective view of the interior lock portion of the self-latching lock with the lid removed, when in the first locked configuration, when viewed from the interior side.
Figure 20:
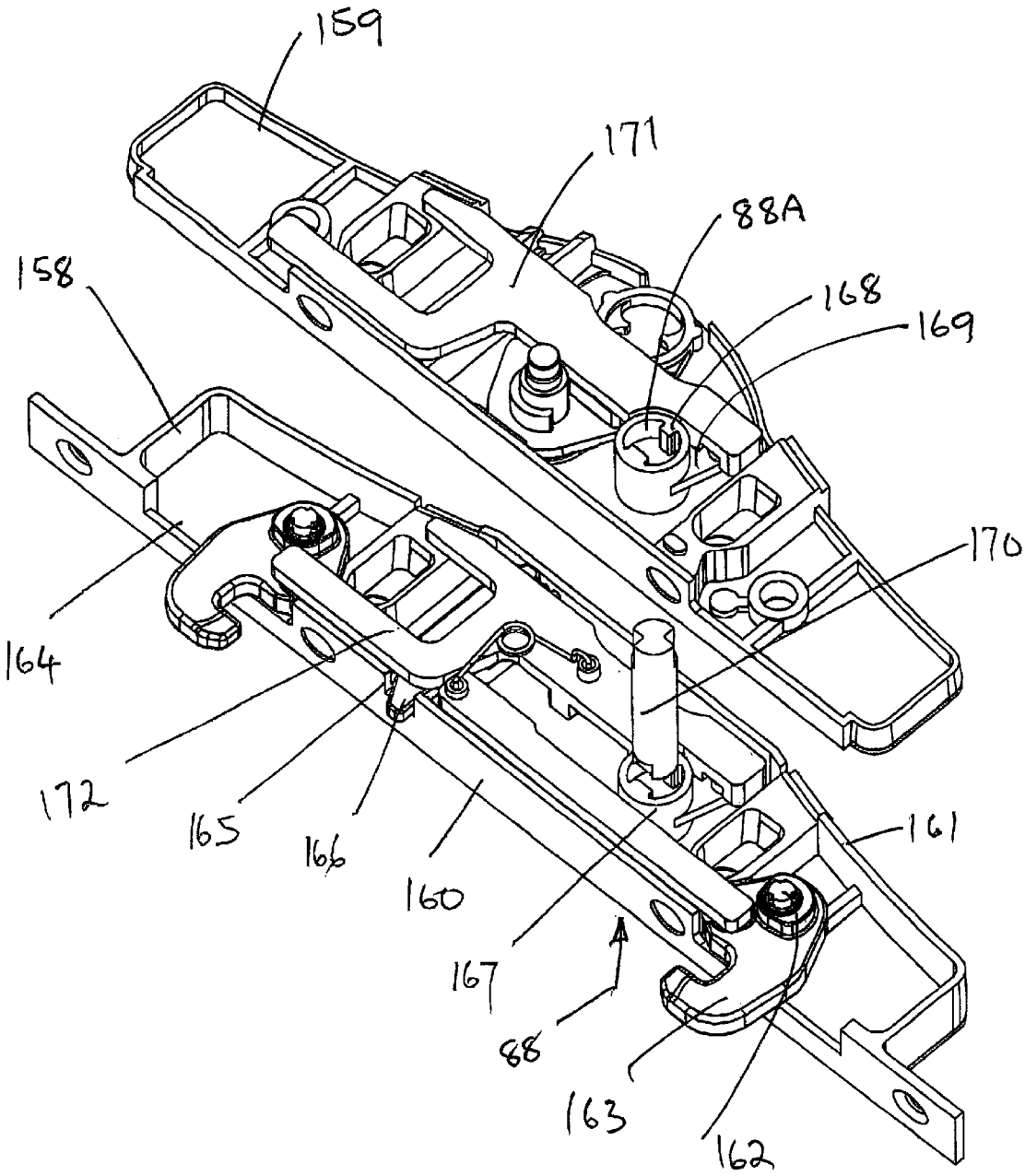
FIG. 20 is a perspective view of the manual lock showing the interior lock portion with the lid removed, and an additional mortise lock portion with the lid removed, when viewed from the interior side.
Figure 21:
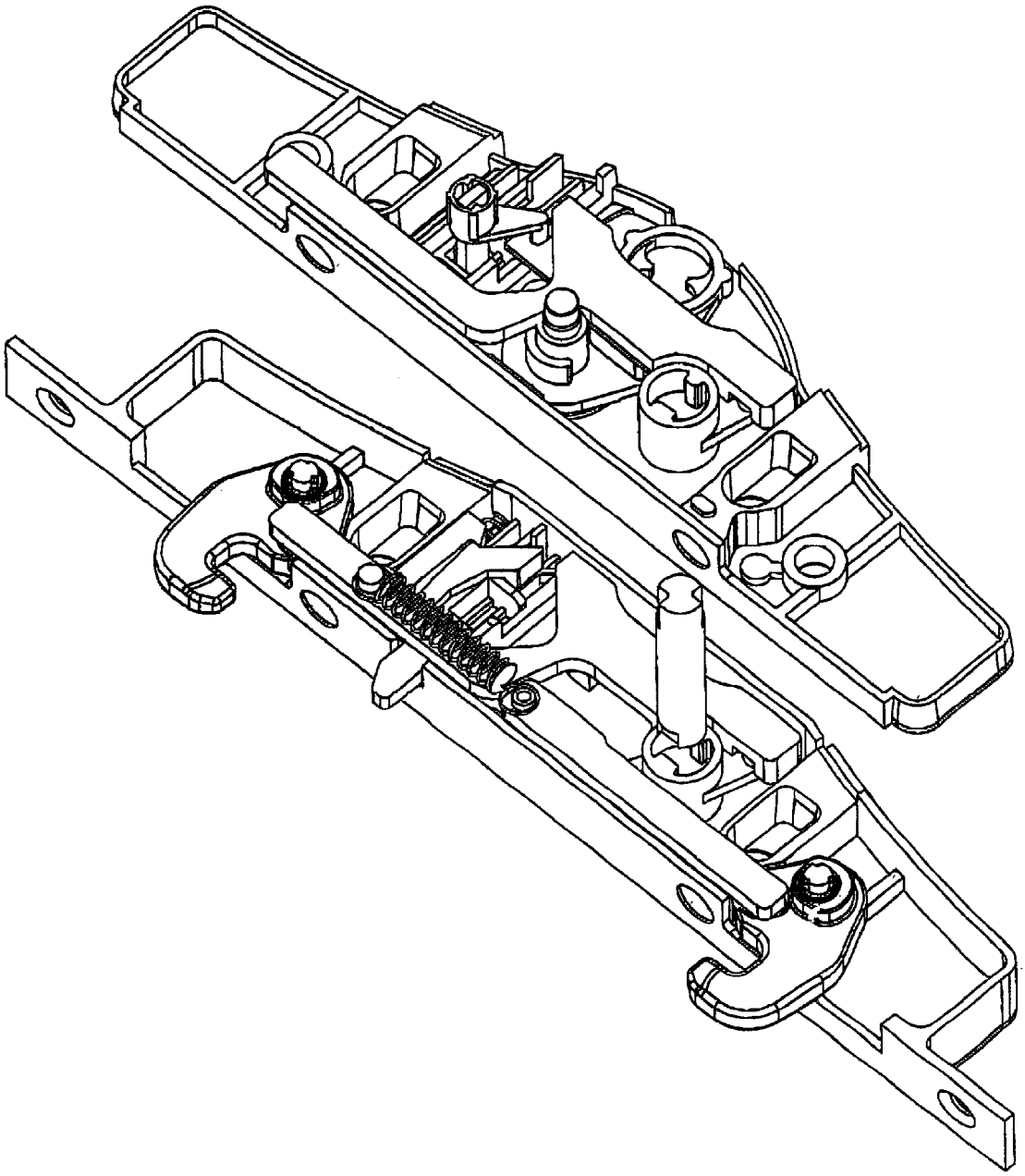
FIG. 21 is a perspective view of the self-latching lock showing the interior lock portion with the lid removed, and an additional mortise lock portion with the lid removed, when viewed from the interior side.

In other preferred self-latching locks, as shown in FIGS. 17 to 19, there is a hand operable interior-snibbing member 135 for locking the lock to the second locked configuration; the sub-slide is supported on a separate rectilinearly displaceable support slide 136 located adjacently the upper slide and between the upper slide and first pinion, and a shaft 137 by meshing with both, connects the rocker 47 to an exterior-operating lever 138, as shown in FIG. 17—the lock being displaceable to the unlatched configuration by use of either the interior-operating or the exterior-operating member. In this embodiment the support slide, which is supported by the upper slide and extensions of the casing, is operably connected to the first train by the sub-slide in the same way that the upper slide is connected to the first train in manual locks. This embodiment requires four apertures through the wing; two for fixing screws, one for first—spindle 35 and one for the shaft 137.

The interior-snibbing member 135 is supported in an aperture in the casing lid 18 in the say way that the operating members are supported; a cylindrical shank portion 139 of each member is within a respective circular aperture in the respective casing, and a circlip is attached to a circlip groove 140 within each shank portion internally within the respective casing.

The shank portion 139 has a substantially coaxial cylindrical recess 141 with axial channels 142. This recess 141 mates with a substantially cylindrical boss 143 having axial finned protrusions 144, as shown in FIG. 18, the boss portion supporting a locking arm 145 which lies in a plane parallel that of the underside of the casing, adjacent to the support slide and in-part in the same plane as part of the upper slide which acts to restrain the locking arm from displacing when the upper slide is in the undisplaced position; the locking arm and upper slide having respective edges 146 and 147 configured to abut when the upper slide and interior-snibbing member are undisplaced, as shown in FIG. 18.

The locking arm has at a free end disposed from the boss 143, an inwardly protruding shoulder, preferably comprising an elongated pin 148, which overlaps the support slide to locate in a horizontally elongated recess 149 in the support slide and disposed towards the upper end of the support slide to operably couple the locking arm and support slide in slide-follower relationship whereby angular displacement of the locking arm causes the support slide to displace while displacement of the support slide causes the locking arm to displace.

When the lock is in the latched configuration, as shown in FIG. 19, the edge 147 is disposed from the boss 143 and the interior-snibbing member 135 can be rotated to cause the locking arm 145 to rotate to cause the support slide to displace to a position corresponding to a second locked configuration, (the support slide can also be displaced to this position by rotating either key). In this second locked configuration the free end of the locking arm is disposed towards the edge 147 of the upper slide and the edge 147 is configured such that in this locking configuration the point on the edge 147 adjacent to the free end of the locking arm is substantially orthogonal to the pivotal axis of the locking arm. Attempted displacement of the upper slide upwardly causes the edge 147 to exert a force on the free end which is defined by a vector passing through the pivotal axis of the locking arm without giving rise to a moment so that the locking arm remains undisplaced restraining the upper slide against displacement, as shown in FIG. 19.

In other preferred embodiments of the self-latching lock, as shown in FIG. 17, the exterior assembly includes an angularly displaceable hand operable member for locking the lock to the second locked configuration, preferably comprising an exterior-locking member 150 similar to the exterior-latching member 82 of the manual lock. The exterior-locking member 150 is supported between an aperture 151 in the exterior lid and an aperture 152 in the exterior casing through which a head portion 153 is accessible to be operable. Preferably this head portion has an accessible slotted recess 154 to accept a key or other tool. The exterior-locking member has on the underside another slotted recess that meshes with a third-spindle 154 which has passage through an aperture in the door to locate in an axial aperture 155 in the boss 143. The boss 143, third-spindle and exterior-locking member 150 are coaxially supported.

The exterior-locking member has a sideways protruding shoulder comprising a stop 156 that locates in an arcular recess coaxial with the exterior-locking member and in which the stop can freely rotate between limits defined by radial shoulders that define the limits of the arcular recess. The stop shoulder and arcular recess are configured such that when the lock is in the undisplaced, unlatched configuration and the exterior-locking member, (and third-spindle), is in an undisplaced position, the stop abuts one end of the arcular recess. From this position the exterior-locking member can be rotated to drive the third-spindle to cause the boss 143 to displace to the position corresponding to the second locked configuration and then be returned to the undisplaced position of the exterior-locking member, (and no further) while leaving the lock in the second locked configuration. Because of the limit on rotation of the exterior-locking member it cannot be rotated to displace the lock from the second locked configuration. The aperture in the boss 143 has two inwardly protruding opposed shoulders 157 engageable by the third shaft and defining two opposed arcular recesses in which the blade-like third-spindle can rotate. Each shoulder 157 is configured such that the undisplaced position of the third-spindle corresponds with the third-spindle being adjacent to a first side of each shoulder 157 from which position the third-spindle can be rotated to urge each first shoulder 157 to rotate to cause the boss to displace to a position corresponding to the second locked position—the exterior-locking member can then be rotated back to the undisplaced position without engaging an opposed other, second side of each shoulder to cause the boss 143 to rotate.

As for the manual lock, a key can be operated to lock the first locked configuration. When the support slide and first pinion are positions corresponding to the second locked configuration, a key can be operated to cause the first pinion to rotate to displace the sub-slide to enable and cause the leading end 64 to abut the exit shoulder 62 to thereby prevent unlocking by the exterior-locking member 150 or interior-snibbing member 135. This embodiment of the latching lock may be locked to and from the first and second locked configurations by key, be locked to the second locked configuration by exterior-locking member, be locked and unlocked from the second locked configuration by interior-snibbing member 135, but only unlocked from the first configuration by key.

In preferred embodiments the sub-slide can only be displaced against the spring a pre-determined distance relative to the support slide, this distance being defined by a shoulder portion adjacent to the recess 57 which acts as a sub-slide stop. Only when the support slide is fully displaced downwardly to the second locking configuration and the sub-slide has been displaced to be adjacent to the sub-slide stop can the shoulder 63 be rotated to depart from the recess between the drive shoulders 60 and 61.

Each cylinder is preferably a substantially conventional pin cylinder having a number of transverse pin chambers in a cylinder housing with each chamber extending from the outer surface of the housing to meet coaxially with a pin chamber in the barrel when the key is removed.

In yet other preferred embodiments of the manual and self latching-latching lock, the engaging members and a plunger are supported in a mortise casing attachable within the hollow frame.

In the mortise lock embodiments, the interior casing described above comprises a first casing portion 159 while the mortise casing 158 comprises a second casing portion, the mortise casing being defined by a front wall 160, a rear wall 161, an upper wall, a lower wall, a side and a lid. The lid and side of the mortise casing have circular apertures to support a rocker first portion, to support the steel rivets 162 that support the engaging members 163, and to provide passage for spindles, shafts and screws. The mortise casing has rectangular apertures 164 and 165 respectively in the front wall to provide passage for the plunger 166 and engaging members while these are omitted from the first casing portion. The rocker previously described comprises a rocker first portion 167 supported within the mortise casing and including the previously described opposed arms protruding from the boss and the underside recess 88; while a second rocker portion 168 resides in the interior casing and comprises a rearward rocker arm 169 and the recess 88A within the boss as described above. The two portions are directly connected by a shaft 170 to be coupled without free movement to act as one and within the invention be considered as a single component with the operable relationships described above, maintained.

Similarly, the upper slide comprises a first upper slide portion 171 substantially as described above supported within the interior casing, however the drive pin, drive slot, and detent recess may be omitted from the first upper slide portion since they are not employed in mortise embodiments. A second upper slide portion 172 including a drive pin on one end, a drive slot on the other end, and a detent recess between as described previously is supported in the mortise casing. The two upper slide portions are directly operably coupled by the rocker comprising two portions to be coupled without free movement to act as one and within the invention be considered as a single component with the operable relationships described above, maintained.

Other minor adaptions are required to provide a practical lock. The interior-operating member connects to, to be coupled without free movement, to the second rocker portion. The exterior-operating member connects to, to be coupled without free movement, to the first rocker portion by shaft. The interior casing does not have apertures to provide passage for the engaging members and plunger.

In yet other embodiments, each engaging member displaces between a retracted position where it is substantially within the interior casing and a latched configuration where it is also substantially within the interior casing and an operative shoulder of is substantially vertical. In these embodiments the catch plate preferably comprises multiple outwardly extending hooked portions each having a substantially vertical shoulder, which in the closed position of the wing, protrudes through an opening in the front casing wall into the interior of the casing to be engageable by the operative shoulder of the associated engaging member.

In yet other embodiments, there is one only an upper engaging member supported at a undefined position within the casing.

Configurations, which will be used most commonly, are as described below. However, possible configurations and those embraced by this invention are not limited to those described below or above.

Manual Lock

- An interior and exterior cylinder without an interior-operating member, each being operable to displace the lock to and from the latched configuration and each being key operable to lock and unlock from the first locked configuration.
- A single, exterior cylinder and interior-operating member, each being operable to displace the lock to and from the latched configuration, the cylinder also being key operable to lock and unlock from the first locked configuration.
- An interior-operating member and no cylinders, the member being operable to displace the lock to and from the latched configuration.
- A single, interior cylinder, the cylinder being key operable to displace the lock to and from the latched configuration and to lock and unlock the lock from the first locked configuration.
- Locks configured as above but in which there is also an exterior-latching member which is operable to displace the lock to the latched configuration.

Self-Latching Lock

- An interior-operating member and an exterior-operating member and an interior-snibbing member, either operating member being operable to displace the lock from the latched configuration, the interior-snibbing member being operable to lock and unlock the lock from the second locked configuration.
- An interior-operating and an exterior-operating member, an interior-snibbing member and an interior cylinder, either operating members being operable to displace the lock from the latched configuration, the interior-snibbing member being operable to lock and unlock the lock from the second locked configuration, the cylinder being operable to lock and unlock the lock from the first and second locked configurations
- An interior-operating member and an exterior-operating member, and interior and exterior cylinders, either operating members being operable to displace the lock from the latched configuration, either cylinder being operable to lock and unlock the lock from the first and second locked configurations
- An interior-operating and an exterior-operating member, and interior and exterior cylinders, an interior-snibbing member, either operating members being operable to displace the lock from the latched configuration, either cylinder being operable to lock and unlock the lock from the first and second locked configurations, the interior-snibbing member being operable to lock and unlock the lock from the second locked configuration
- Locks configured as above but in which there is also an exterior-locking member, which is operable to displace the lock to the second locked configuration.

Throughout this specification and claims which follow, unless the context requires otherwise, the word "comprise", or variations such as "comprises" or "comprising", will be understood to imply the inclusion of a stated integer or group of integers but not the exclusion of any other integer or group of integers.

Throughout this specification and claims which follow, unless the context requires otherwise, the positional prepositions such as rear, forward are used to assist in description of the preferred embodiments and have in general no absolute significance.

What is claimed is:

1. A manual lock for a moveable wing comprising a hollow frame supporting an in-fill portion and defined by an interior and an opposed exterior side, the manual lock including an engageable means, a casing, engaging means including at least one engaging member supported by the casing and displaceable to a latched configuration to be engaged with the engageable member, to restrain the wing from displacing in an opening direction operating means to cause each engaging member to displace to and from the latched configuration including a hand operable interior-operating member operably connected by a rocker to each engaging member by slide means including a rectilinearly displaceable slide, the operating means further including a cylinder having a key operable barrel operably coupled to a first pinion, the first pinion and slide being operably connected by a drive recess of the slide disposed towards the first pinion and defined by a first drive shoulder and the second drive shoulder and a protruding third drive shoulder of the first pinion radially disposed from the axis of rotation of the first pinion and which locates between the first and second drive shoulders to couple the slide and first pinion whereby displacement of one causes displacement of the other, the slide being displaceable to and from a latching position corresponding to each engaging member being latched by operation of the interior-operating member to cause the rocker to displace to cause the slide to displace and by operation of the cylinder to cause the first pinion to displace to cause the slide to displace, the manual lock being displaceable to a first locked configuration characterized by the slide being in the latching position, each engaging member being latched and the first pinion being in a further displaced position wherein the third drive shoulder has left the drive recess to abut the surface of the exit shoulder which is then defined by a normal vector which passes through the axis of rotation of the first pinion, the slide thereby being unable to exert a moment on the first pinion to cause the first pinion to rotate to thereby be restrained from displacing by the first pinion.

2. A manual lock according to claim 1, wherein the slide includes a sub-slide portion which is displaceable relative to the remainder slide portion between limits comprising an undisplaced position towards which it is biased, and a fully displaced position, the second drive shoulder and exit shoulder comprising part of the sub-slide, the first locked configuration being further characterized by the sub-slide being in the fully displaced position with the third drive shoulder abutting the exit shoulder to retain the sub-slide in the fully displaced position.

3. A manual lock according to claim 1, wherein the operating means includes a cylinder comprising an exterior cylinder having a key operable barrel operably coupled coaxially to a rearwardly disposed offset pinion meshing with a spindle pinion, and a first-spindle having passage through the frame to coaxially and operably interconnect the spindle pinion and the first pinion, the manual lock being further characterized by increased room to operate the key facilitated by the axis of rotation of the cylinder barrel being offset and rearward of the axis of rotation of the first spindle and rearward of the hollow portion of the frame.

4. A manual lock according to claim 3, wherein the engageable means comprises a catch plate, the engaging means comprises a pair of counteracting engaging arms supported relative to the casing each having a free end with a hooked portion displaceable from a retracted configuration where it is substantially within the casing to a latched configuration where it protrudes from the casing to engage the catch plate, each angularly displacing in the opposite direction to the other, and wherein the slide means comprises counter-acting rectilinearly displaceable slides interconnecting the upper and the lower engaging arm to the rocker, one of said slides including the first and second drive shoulders and exit shoulder, each engaging arm and associated slide cooperating in the latched configuration to deadlock the engaging arm to restrain the engaging arm from being displaced from the latched configuration by means other than the operating means, and control means to restrain each engaging arm from being displaced to engage the catch plate unless the catch plate and wing are relatively positioned to enable the said engagement including an outwardly biased plunger supported in the casing to be displaceable from a fully extended position in which it simultaneously protrudes from the casing while engaging a slide to restrain the slide means from displacing.

5. A self-latching lock for a moveable wing comprising a hollow frame supporting an in-fill portion and defined by an interior and an exterior side, the self-latching lock including an engageable means, a casing, engaging means including at least one engaging member supported by the casing and displaceable to a latched configuration corresponding to a latched lock to be engaged with the engageable means, to restrain the wing from displacing in an opening direction, operating means to cause each engaging member to displace from the latched configuration including a hand operable interior-operating member and a hand operable exterior-operating member each operably connected by a rocker to each engaging member by slide means including a rectilinearly displaceable slide, locking means including a deadlocking slide comprising a support slide, a cylinder having a key operable barrel operably coupled to a first pinion and an interior-snibbing member operably coupled to the deadlocking slide by a locking-cam having an arm with an end shoulder, the first pinion and deadlocking slide being operably connected by a drive recess of the deadlocking slide disposed towards the first pinion and defined by a first drive shoulder and a second drive shoulder and a protruding third drive shoulder radially disposed from the axis of rotation of the first pinion and which locates between the first and second drive shoulders to couple the deadlocking slide and first pinion whereby displacement of one causes displacement of the other, the deadlocking slide being displaceable to and from a locking configuration corresponding to a latched lock by operation of the interior-snibbing member to cause the cam to rotate to cause the deadlocking slide to displace and by operation of the cylinder to cause the first pinion to displace to cause the deadlocking slide to displace, the lock being so lockable to a second locked configuration characterized by the third drive shoulder being within the drive recess and the arm end shoulder being adjacent to a portion of the slide defined by a normal vector which passes through the axis of rotation of the locking-cam, the slide thereby being unable to exert a moment on the locking-cam to cause the locking-cam to rotate, the slide thereby being restrained from displacing from the locking configuration, the lock being lockable to a first locked configuration from which it can only be unlocked by the cylinder, the first locked configuration being characterized by the first pinion being further displaced to have caused the third drive shoulder to leave the drive recess and to abut the surface of the exit shoulder which is then defined by a normal vector which passes through the axis of rotation of the first pinion, the deadlocking slide thereby being unable to exert a moment on the first pinion to cause the first pinion to rotate to thereby be restrained from displacing.

6. A self-latching lock according to claim 5, wherein the deadlocking slide includes a subsidibary sub-slide which is displaceable relative to the other deadlocking slide portion between limits comprising an undisplaced position towards which it is biased, and a fully displaced position, the second drive shoulder and exit shoulder comprising part of the sub-slide, the first locked configuration being further characterized by the sub-slide being in the fully displaced position with the third drive shoulder abutting the exit shoulder to retain the sub-slide in the fully displaced position.

7. A self-latching lock according to claim 5, wherein the locking means includes a cylinder comprising a rearwardly disposed exterior cylinder having a key operable barrel operably coupled coaxially to a rearwardly disposed offset pinion meshing with a spindle pinion, and a first-spindle having passage through the frame to couple and coaxially interconnect the spindle pinion and a first pinion, the self-latching lock being characterized by increased room to operate the key facilitated by the axis of rotation of the cylinder barrel being offset and rearward of the axis of rotation of the first-spindle and rearward of the axis of rotation of the first spindle and rearward of the hollow portion of the frame.

8. A self-latching lock according to claim 7, wherein the engageable means comprises a catch plate, the engaging means comprising a pair of counteracting engaging arms supported relative to the casing each having a free end with a hooked portion displaceable from a retracted configuration where the free end is substantially within the casing to a latched configuration where the free end protrudes from the casing to engage the catch plate, each angularly displacing in the opposite direction to the other, and wherein the slide means comprises counter-acting rectilinearly displaceable slides interconnecting the upper and the lower engaging arms to the rocker, said slide means being biased towards the configuration corresponding to the latched configuration, each engaging arm and associated slide cooperating in the latched configuration to deadlock the engaging arm to restrain the engaging arm from being displaced from the latched configuration by means other than the operating mean, and control means to restrain each engaging arm from being displaced to engage the catch plate unless the catch plate and wing are relatively positioned to enable the said engagement including an outwardly biased plunger supported in the casing to be displaceable from a fully extended position in which it simultaneously protrudes from the casing while engaging a slide to restrain the slide means from displacing.

9. A manual lock for a moveable wing comprising a hollow frame supporting an in-fill portion and defined by an interior and an exterior side, the manual lock including, an engageable means, a casing, engaging means including at least one engaging member supported by the casing and displaceable to a latched configuration to be engaged with the engageable means to restrain the wing from displacing in an opening direction, operating means to cause each engaging member to displace to and from the latched configuration including a hand operable interior-operating member operably connected to a first pinion and each engaging member, the operating means further including a rearwardly disposed exterior cylinder having a key operable barrel operably coupled coaxially to a rearwardly disposed offset pinion meshing with a spindle pinion, and a first-spindle having passage through the frame to coaxially interconnect the spindle pinion and the first pinion, the interior-operating member being displaceable by hand to and from a latching configuration corresponding to a latched manual lock with each engaging member being in a latched configuration and by operation of the exterior cylinder to cause the first pinion to displace to cause the interior-operating member and each engaging member to displace, and with the interior-operating member remaining in the latching configuration, the first pinion being further displaceable by operation of the exterior cylinder to restrain the interior-operating member from being displaced from the latching configuration, the manual lock being characterized by increased room to operate the key facilitated by the axis of rotation of the cylinder barrel being offset and rearward of the axis of rotation of the spindle and rearward of the axis of rotation of the first spindle and rearward of the hollow portion of the frame.

10. A self-latching lock for a moveable wing comprising a hollow frame supporting an in-fill portion and defined by an interior and an exterior side, the self-latching lock including, an engageable means, a casing, engaging means including at least one engaging member supported by the casing and displaceable to a latched configuration corresponding to a latched lock to be engaged with the engageable means to restrain the wing from displacing in an opening direction, operating means to cause each engaging member to displace from the latched configuration including a hand operable interior-operating member and a hand operable exterior-operating member each operably connected to each engaging member, locking means to restrain the operating means from displacing each engaging member from the latched configuration including an interior-snibbing member, a rearwardly disposed exterior cylinder having a key operable barrel operably coupled coaxially to a rearwardly disposed offset pinion meshing with a spindle pinion, and a first-spindle having passage through the frame to coaxially interconnect the spindle pinion and a first pinion, the interior-snibbing member being displaceable by hand to displace the latched lock to a second locked configuration, the exterior cylinder being operable to displace the first pinion to displace the latched lock to a second locked configuration, the first pinion being further displaceable by operation of the exterior cylinder to restrain the lock from being displaced from the second locked configuration, the self-latching lock being characterized by increased room to operate the key facilitated by the axis of rotation of the cylinder barrel being offset and rearward of the axis of rotation of the first-spindle and rearward of the axis of rotation of the first spindle and rearward of the hollow portion of the frame.

* * * * *